US012680393B2

(12) United States Patent
Trunk et al.

(10) Patent No.: US 12,680,393 B2
(45) Date of Patent: Jul. 14, 2026

(54) NON-UNIFORM ROLLER CONE

(71) Applicant: Schlumberger Technology Corporation, Sugar Land, TX (US)

(72) Inventors: Philip Trunk, Houston, TX (US); Scott McDonough, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/060,299

(22) Filed: Feb. 21, 2025

(65) Prior Publication Data

US 2025/0270882 A1 Aug. 28, 2025

Related U.S. Application Data

(60) Provisional application No. 63/557,061, filed on Feb. 23, 2024.

(51) Int. Cl.

| | |
|---|---|
| ***E21B 10/16*** | (2006.01) |
| ***E21B 10/14*** | (2006.01) |
| ***E21B 10/50*** | (2006.01) |
| ***E21B 10/52*** | (2006.01) |
| ***E21B 10/55*** | (2006.01) |
| ***E21B 10/56*** | (2006.01) |

(52) U.S. Cl.

CPC ..... *E21B 10/16* (2013.01); *E21B 10/14* (2013.01); *E21B 10/50* (2013.01); *E21B 10/52* (2013.01); *E21B 10/55* (2013.01); *E21B 10/56* (2013.01)

(58) Field of Classification Search

CPC ..... E21B 10/14; E21B 10/16; E21B 10/50; E21B 10/56

See application file for complete search history.

(56) References Cited

U.S. PATENT DOCUMENTS

| | | | | | |
|---|---|---|---|---|---|
| 2,774,571 | A * | 12/1956 | Morlan | E21B 10/16 | 175/426 |
| 3,134,447 | A * | 5/1964 | Mcelya | E21B 10/06 | 175/332 |
| 4,056,153 | A * | 11/1977 | Miglierini | E21B 10/52 | 175/376 |
| 5,881,829 | A * | 3/1999 | Dimond | E21B 10/16 | 175/431 |
| 6,942,045 | B2 * | 9/2005 | Dennis | E21B 10/16 | 175/426 |
| 7,621,345 | B2 * | 11/2009 | Cepeda | E21B 10/16 | 175/341 |

(Continued)

FOREIGN PATENT DOCUMENTS

| | | | | |
|---|---|---|---|---|
| CA | 2776640 | A1 * | 4/2011 | E21B 10/28 |
| CN | 111911077 | A * | 11/2020 | E21B 10/50 |
| CN | 113202415 | A * | 8/2021 | E21B 10/18 |

*Primary Examiner* — Jennifer H Gay

(74) *Attorney, Agent, or Firm* — Kyle R. Miiller

(57) ABSTRACT

A roller cone may include an innermost region having roller cone cutting elements arranged thereon such that the cutting elements may be closer to a radial axis of a drill bit. A roller cone may include a central region having roller cone cutting elements arranged thereon. The central region of a roller cone may also include multiple zones where the cutting element density within the central region and/or zones may vary between zones and/or regions. The cutting element density may be no less than 75% greater in one zone and/or region than the cutting element density of another zone and/or region.

20 Claims, 11 Drawing Sheets

(56) References Cited

U.S. PATENT DOCUMENTS

| | | | | |
|---|---|---|---|---|
| 7,779,936 | B2 * | 8/2010 | Felderhoff | E21B 10/16 175/341 |
| 9,004,198 | B2 * | 4/2015 | Kulkarni | E21B 10/22 175/371 |
| 9,074,431 | B2 * | 7/2015 | Portwood | E21B 10/16 |
| 9,212,523 | B2 * | 12/2015 | Yong | E21B 10/58 |
| 9,353,575 | B2 * | 5/2016 | Zahradnik | E21B 7/00 |
| 10,767,420 | B2 * | 9/2020 | McDonough | E21B 10/16 |
| 10,907,414 | B2 * | 2/2021 | Schoen | E21B 10/14 |
| 11,136,830 | B2 * | 10/2021 | McDonough | E21B 10/16 |
| 11,326,402 | B2 * | 5/2022 | Tu | E21B 10/16 |
| 12,392,199 | B2 * | 8/2025 | Grimes | E21B 10/16 |
| 2004/0118609 | A1 * | 6/2004 | Dennis | E21B 10/16 175/57 |
| 2007/0227781 | A1 * | 10/2007 | Cepeda | E21B 10/16 175/374 |
| 2009/0188724 | A1 * | 7/2009 | Portwood | E21B 10/16 175/341 |
| 2010/0071963 | A1 * | 3/2010 | Felderhoff | E21B 10/16 175/401 |
| 2011/0079444 | A1 * | 4/2011 | Kulkarni | E21B 10/22 175/428 |
| 2013/0140093 | A1 * | 6/2013 | Zhou | E21B 10/16 175/336 |
| 2013/0313021 | A1 * | 11/2013 | Zahradnik | E21B 10/14 175/57 |
| 2016/0145945 | A1 * | 5/2016 | Portwood | E21B 10/50 76/108.4 |
| 2018/0106113 | A1 * | 4/2018 | McDonough | E21B 10/16 |
| 2019/0136633 | A1 * | 5/2019 | Schoen | E21B 10/42 |
| 2019/0249497 | A1 * | 8/2019 | McDonough | E21B 10/16 |
| 2020/0362638 | A1 * | 11/2020 | Tu | E21B 10/60 |
| 2021/0087886 | A1 * | 3/2021 | Tu | E21B 10/60 |
| 2024/0328259 | A1 * | 10/2024 | Grimes | E21B 10/16 |
| 2025/0270882 | A1 * | 8/2025 | Trunk | E21B 10/56 |

* cited by examiner

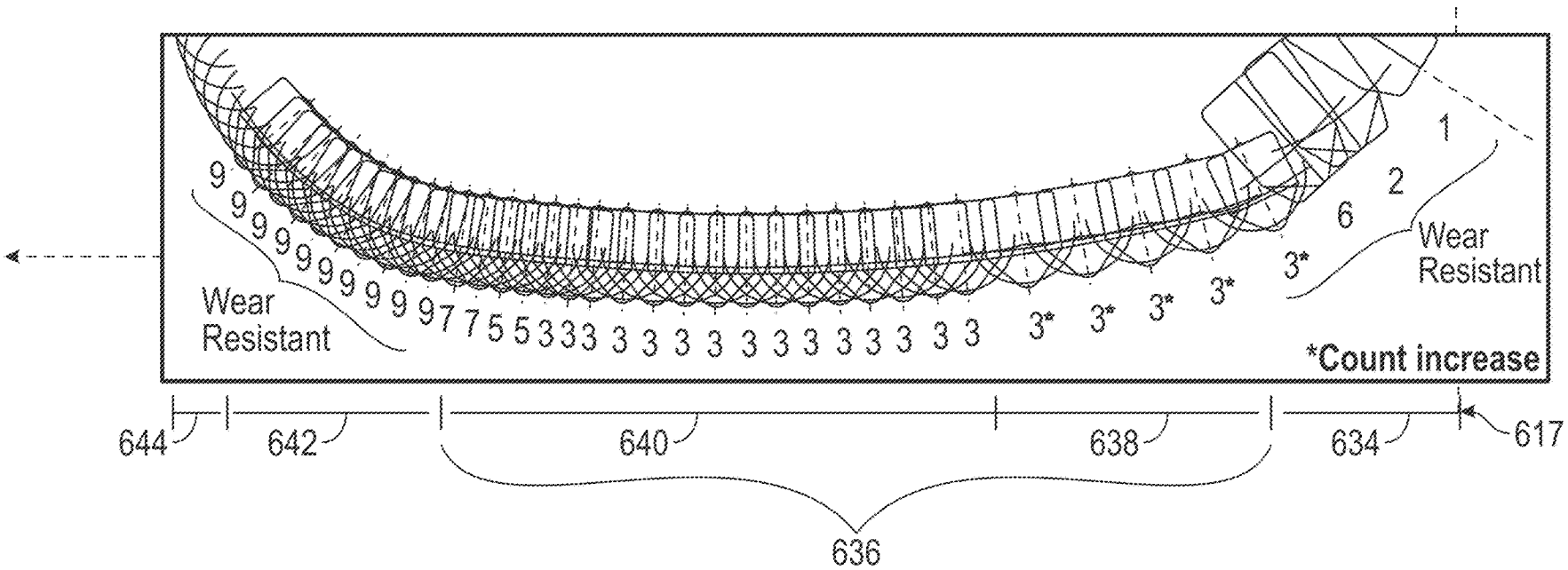
617
634
638
636
640
642
644
*Count increase
Wear Resistant
Wear Resistant
1
2
6
3*
3*
3*
3*
3*
3
3
3

NON-UNIFORM ROLLER CONE

CROSS-REFERENCE TO RELATED APPLICATION

This application claims the benefit of, and priority to, U.S. Patent Application No. 63/557,061 entitled "Non-Uniform Roller Cone" filed Feb. 23, 2024, which is incorporated herein by this reference in its entirety.

BACKGROUND

The majority of footage drilled in an earth formation uses a plurality of fixed cutting elements to scrape and fracture rock and other material in the downhole environment. The torque experienced by the cutting elements of the drill bit varies with the radial position of the cutting element as well as the depth of cut and strength of the formation.

SUMMARY

In some aspects, the techniques described herein relate to a roller cone including: an innermost region having roller cone cutting elements arranged thereon, a first central region having roller cone cutting elements arranged thereon, and a second central region having roller cone cutting elements arranged with a cutting element density no less than 75% greater than the cutting element density of the first central region.

In some aspects, the techniques described herein relate to a drill bit including: a bit body having a rotational axis; a roller cone supported by the bit body, the roller cone including: an innermost region having roller cone cutting elements arranged thereon, a first central region having roller cone cutting elements arranged thereon, and a second central region having roller cone cutting elements arranged thereon with a cutting element density no less than 75% greater than the cutting element density of the first central region; and a first fixed blade fixed relative to the bit body with fixed blade cutting elements affixed thereto radially overlapping at least the first central region.

In some aspects, the techniques described herein relate to a roller cone including: an innermost region having roller cone cutting elements arranged thereon, a first central region having roller cone cutting elements arranged thereon with a toughness greater than the roller cone cutting elements of the innermost region, and a second central region having roller cone cutting elements with a hardness greater than the roller cone cutting elements of the first central region.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 6-1 is a cutting profile of a roller cone, according to at least some embodiments of the present disclosure.

FIG. 6-2 is a graph illustrating a cutting element density of a roller cone with an inner region and an outer region, according to at least some embodiments of the present disclosure.

FIG. 6-3 is a graph illustrating a cutting element density of a roller cone with at least four regions, according to at least some embodiments of the present disclosure.

FIG. 6-4 is a graph illustrating a cutting element density of a roller cone where the central region is divided into multiple zones in accordance with various embodiments.

FIG. 6-5 is a graph illustrating various zones within a cutting profile that may have varying cutting element densities in accordance with numerous embodiments.

FIGS. 8-1 and 8-2 are graphs illustrating the relative workrate of cutting elements on drill bits, according to at least some embodiments of the present disclosure.

DETAILED DESCRIPTION

Figure 1:
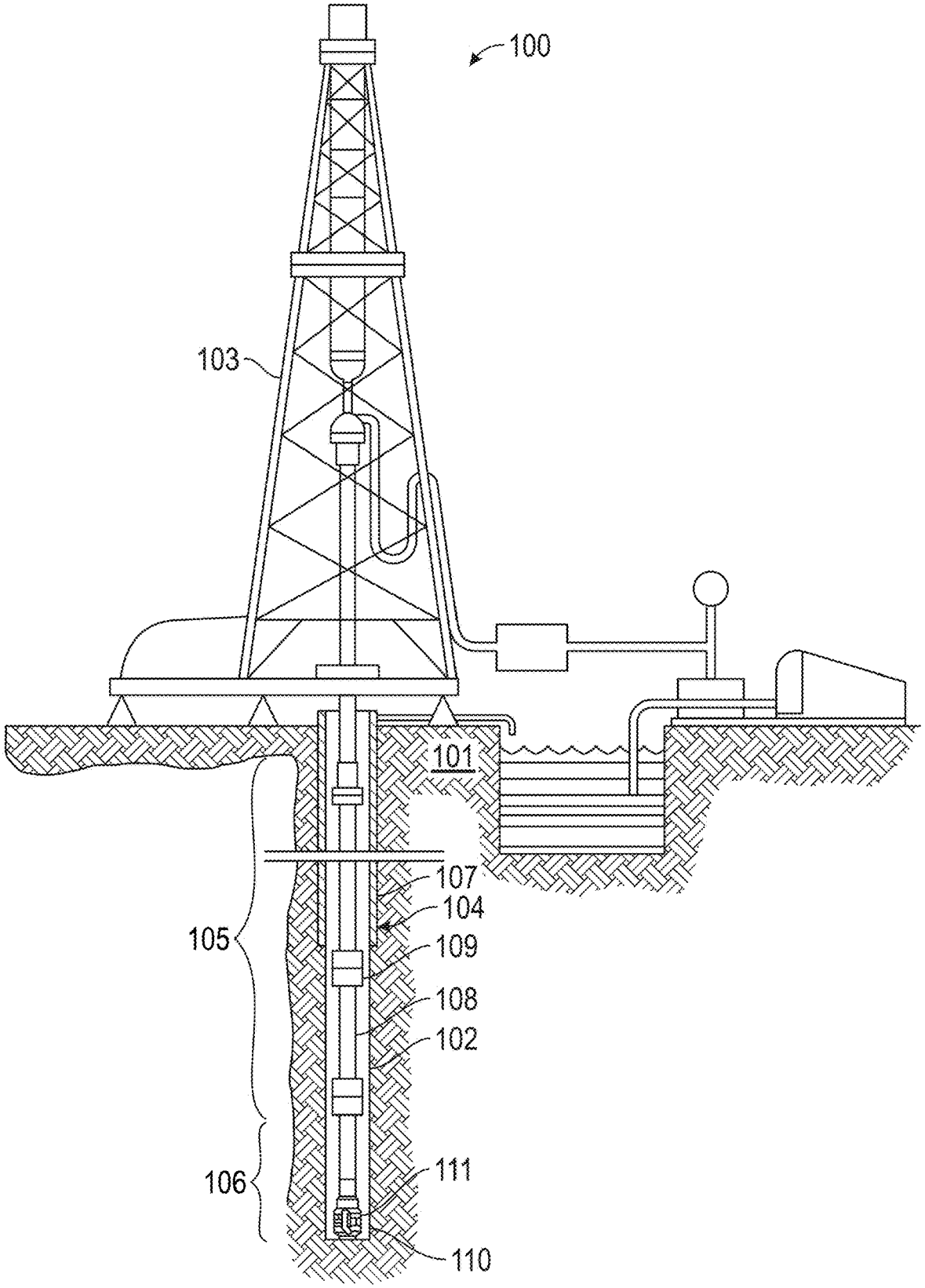
FIG. 1 illustrates an embodiment of a drilling system and downhole environment in which a drill bit, according to the present disclosure, may be used.

Embodiments of the present disclosure generally relate to devices, systems, and methods for drilling in an earth formation. More particularly, some embodiments of the present disclosure relate to hybrid drill bits for degrading and/or removing material from the earth formation. In some embodiments, a drill bit includes a roller cone and a fixed blade in sequence to crack, crush, deform, or otherwise degrade the material of the earth formation before removing the degraded material. In some embodiments, the roller cone rolls across a surface of the formation material of the earth formation to apply a compression force and/or a shear force to degrade the formation material into a degraded material, and the fixed blade drags across or through the degraded material to remove at least a portion of the degraded material.

In some embodiments, a drill bit according to the present disclosure includes a bit body with a rotational axis. The roller cone is supported by the bit body and rotatable around a cone axis that is oriented substantially radially to the rotational axis of the bit body, such that the roller cone rotates around the cone axis while the bit body rotates around the rotational axis. In some embodiments, the drill bit may further include a fixed blade that is fixed relative to and/or integrally formed with the bit body. The roller cone and the fixed blade each may include a plurality of cutting elements affixed thereto. In various embodiments, the cutting elements affixed to the roller cone may be located closest to the rotational axis of the drill bit such that they are closer to the axis than those on the fixed blade.

In some embodiments, the roller cone may have a plurality of regions in the axial direction of the cone axis (i.e., the axis around which the roller cone rotates as the bit body rotates around the rotational axis). In some embodiments, the roller cone may include an innermost region proximate to a first axial end of the cone axis and proximate to the rotational axis of bit body. The roller cone may also include a first central region adjacent to and radially outward from the innermost region (relative to the rotational axis of the bit body). The roller cone may also include a second central region adjacent to and radially outward from the first central region (relative to the rotational axis of the bit body). The roller cone can also include an outermost region adjacent to and radially outward from the second central region (relative to the rotational axis of the bit body).

As will be described in more detail herein, drill bit experiences the greatest torque on cutting elements in the second central region and/or an outer region of the cutting profile of the drill bit. In some embodiments, more aggressive degrading of formation material in the second central region by the roller cone reduces the torque experienced at the shear cutting elements of the fixed blades of the drill bit. Adjusting the cutting element density of the various regions or zones of the roller cone can improve a rate of penetration relative to torque on the bit. Additionally, the variable cutting element density can help to limit failures of cutting elements experiencing high forces and/or torques that may be located on the fixed blades. In some embodiments, the roller cone regions can be at least partially aligned with the dimensions and/or positions of the primary, secondary, and tertiary fixed blades. In some embodiments, a drill bit, according to the present disclosure can remove material in challenging earth formations with greater drilling rate, less torque, greater weight-on-bit, less wear or damage to the drill bit, or any combinations thereof relative to conventional drag bits or fixed blade drill bits.

FIG. 1 illustrates an embodiment of a drilling system and downhole environment in which a drill bit, according to the present disclosure, may be used. FIG. 1 shows one example of a drilling system 100 for drilling an earth formation 101 to form a wellbore 102. The drilling system 100 may include a drill rig 103 used to turn a drilling assembly 104 which extends downward into the wellbore 102. The drilling assembly 104 may include a drill string 105 and a bottom-hole assembly (BHA) 106 attached to the downhole end of the drill string 105. Where the drilling system 100 is used for drilling formation, a drill bit 110 can be included at the downhole end of the bottom hole assembly or BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the wellbore 102 as it is being drilled, and for preventing the collapse of the wellbore 102. The drilling fluid 111 carries drill solids including drill fines, drill cuttings, and other swarf from the wellbore 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may include any features or elements suitable for degrading downhole materials. For instance, the bit 110 may be a drill bit suitable for drilling the earth formation 101. While embodiments of a drill bit 110 for drilling the earth formation 101 will be described herein, it should be understood that, in some embodiments, features described herein are applicable to a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface by the drilling fluid 111 or may be allowed to fall downhole. The conditions of the equipment of the drilling system 100, the formation 101, the wellbore 102, the drilling fluid 111, or other parts of the wellsite can change during operations.

Figure 2:
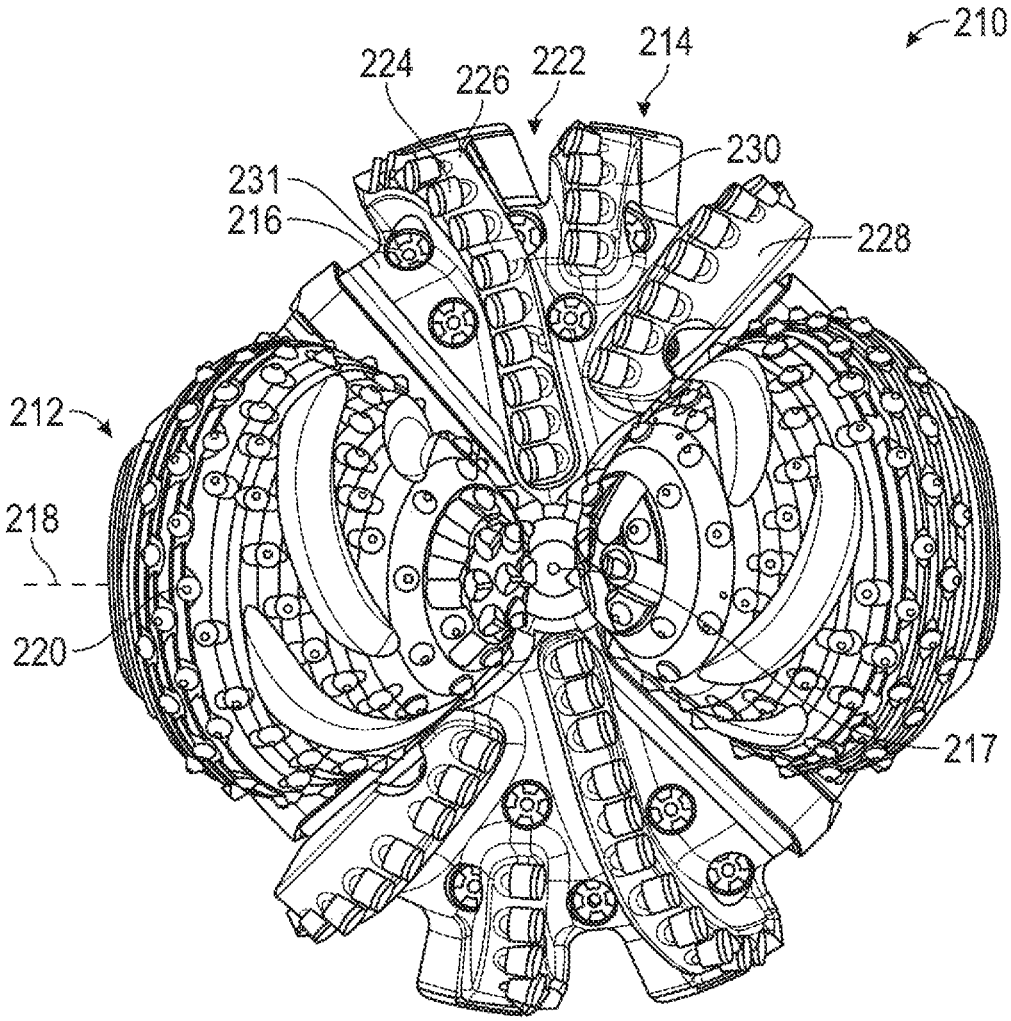
FIG. 2 illustrates a bottom view of a hybrid drill bit with a roller cone and a fixed blade, according to at least some embodiments of the present disclosure.

FIG. 2 illustrates a bottom view of an embodiment of a hybrid drill bit 210 with a roller cone 212 and a fixed blade 214. In some embodiments, the roller cone 212 may be supported by a bit body 216. As the bit body 216 rotates around a rotational axis 217 of the drill bit 210, contact between the roller cone 212 and the formation material produces a rotation of the roller cone 212 around the cone axis 218. In various embodiments, the cone axis 218 may be oriented with an outward component that may be substantially radial to the rotational axis 217. In some embodiments, the cone axis 218 may be oriented with an outward component that may be raked relative to the radial direction and a rotational direction of the rotational axis 217. In some examples, a raked cone axis 218 increases a shear force between cutting elements of the roller cone 212 and the formation material as the drill bit 210 and roller cone 212 rotates. As can be appreciated, various embodiments of a hybrid drill bit 210 can improve the wear life of the drill bit by having a roller cone 212 in which the roller cone cutting elements 220 that can be configured to cut the innermost region of the formation material in the downhole. In other words, in many embodiments, the roller cone cutting elements may be configured to be closest to the rotational axis of the bit as compared to the cutting elements on a fixed cutting blade 214.

In numerous embodiments, a cutting element of the roller cone(s) 212 and/or the fixed blade(s) 214, including but not limited to a shear cutting element, an apexed cutting element (conical, bullet, ridged), or another cutting element with another surface geometry, applies a force to the degraded material to remove at least a portion of the degraded material. In some embodiments, the cutting element may be a spinning cutting element that allows the cutting element (such as a shear cutting element) to spin in a housing and expose different cutting surfaces to the formation. In many embodiments, the cutting element(s) may be made of or includes a polycrystalline diamond compact (PDC). In some embodiments, the cutting element(s) may be made of or includes a carbide, such as tungsten carbide. As will be described herein, the cutting elements may have different compositions and/or material properties related to the location of the cutting element in the roller cone 212 and/or fixed blade 214.

In some embodiments, the roller cone cutting elements 220 affixed to the roller cone 212 may include apexed cutting elements. For example, the roller cone cutting elements 220 may have an apexed geometry, such as a conical cutting element, a bullet cutting element (i.e., curved conical surface), or a ridge or chisel type cutting element. As the roller cone 212 rotates around the cone axis 218, the roller cone cutting elements 220 can apply a compression force to the formation material with a relatively high pressure at the apex of the apexed cutting element to degrade the formation material. Accordingly, various embodiments of the roller cone 212 can be instrumental in cutting the innermost region of the downhole formation. As can be appreciated, the roller cone 212 can be configured with cutting elements 220 in a variety of formations and positions and in some embodiments, the cutting elements 220 can be positioned closer to the rotational axis 217 than cutting elements on the fixed blades 214. Roller cone cutting elements 220 can be placed within the roller cone 212 using any number of suitable methods. For example, in some embodiments, the roller cone cutting elements 220 can be press fit, compression fit, mechanically fastened, adhered, brazed, or otherwise affixed to the roller cone 212.

In some embodiments of a hybrid bit, the bit body 216 can have fixed blades 214 affixed thereto and/or integrally formed therewith. The fixed blades 214 have slots 222 therebetween. In some embodiments, the fixed blade cutting elements 224 affixed to the fixed blades 214 are or include shear cutting elements. For example, the fixed blade cutting elements 224 may have a substantially perpendicular or flat geometry, such as a cylindrical shear cutting element or angled shear cutting element. As the bit body 216 rotates around the rotational axis 217, the fixed blade cutting elements 224 can apply a shear force to the formation material to degrade and/or remove the formation material. It should be appreciated that in various embodiments, the fixed blade cutting elements 224 can press fit, compression fit, mechanically fastened, adhered, brazed, or otherwise affixed to the fixed blade(s) 214.

In some embodiments, the drill bit 210 can have sets of fixed blades 214 that can include a plurality fixed blades 214 of different geometries that can be designed to cluster the fixed blade cutting elements 224 together with slots 222 therebetween. For example, a set of fixed blades 214 may include a primary blade 226 with fixed blade cutting elements 224 arranged from an outermost surface of the drill bit cutting profile to proximate the rotational axis 217 in the cone and/or inner region of the drill bit cutting profile. In some examples, a secondary blade 228 may include fixed blade cutting elements 224 arranged in a shorter portion of the radial distance relative to the rotational axis 217, such as from the outermost surface of the drill bit cutting profile to the first central region of the drill bit cutting profile. In some examples, a tertiary blade 230 may include fixed blade cutting elements 224 arranged in less of the radial distance relative to the rotational axis 217 than the secondary blade 228, such as from the outermost surface of the drill bit cutting profile to the second central region of the drill bit cutting profile.

In some embodiments, the primary blade 226 and the secondary blade 228 may have a slot 222 therebetween that can allow fluid flow between the blades to clear cuttings, swarf, or other debris. In some embodiments, a hydraulic nozzle 231 may direct a fluid flow, such as a drilling fluid flow, into the slot to clear the cuttings, swarf, or other debris. In some embodiments, degraded material remains in the degraded formation after the fixed blade cutting elements 224 of the primary blade 226 remove material from the formation. The fluid flow can further dislodge or flush remaining degraded material from the formation to further assist the second plurality of fixed blade cutting elements 224 of the secondary blade 228 further degrading and/or removing material.

In various embodiments, a cutting element density of the roller cone cutting elements 220 can vary on the roller cone 212 in a radial direction relative to the rotational axis 217 of the drill bit 210. For example, in some embodiments, the cutting element density can vary based at least partially on the location and arrangement of fixed blade cutting elements 224 on the fixed blades 214 of the hybrid drill bit 210. In at least some embodiments, by degrading the formation material by different amounts (relative to a radial direction) with the roller cone 212, torque on the fixed blade cutting elements 224 may be reduced and/or balanced to allow more efficient removal of formation material by the fixed blade cutting elements 224.

Figure 3:
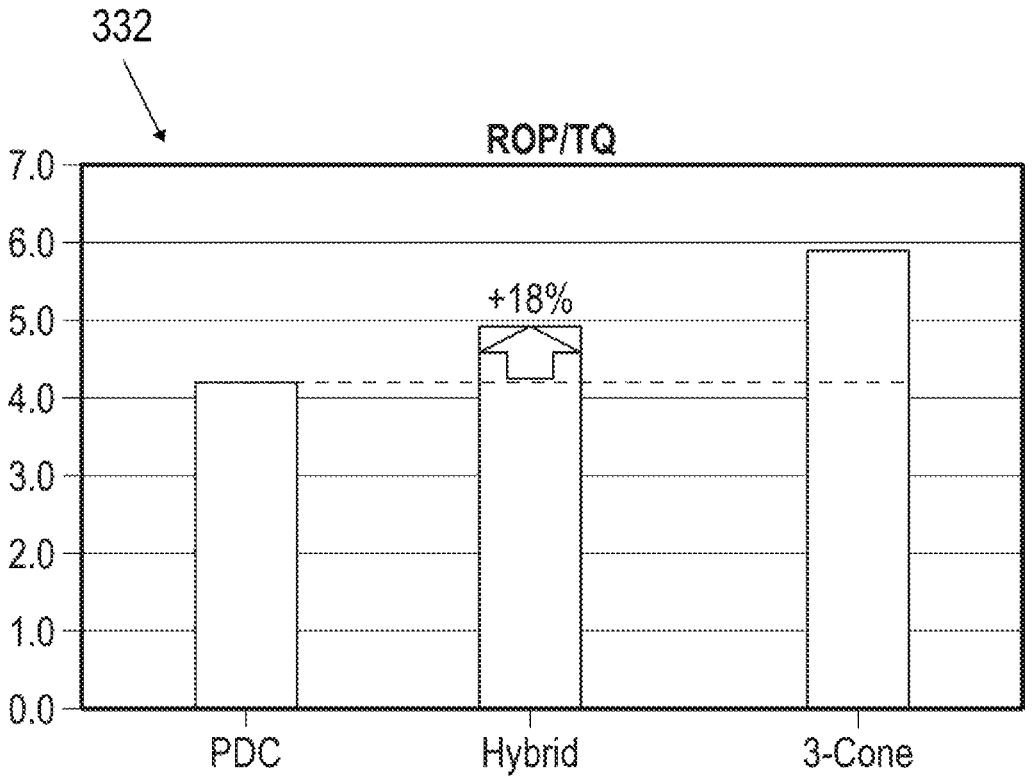
FIG. 3 is a graph of a ratio of rate of penetration (ROP) to torque (TQ) applied to a hybrid drill bit, according to at least some embodiments of the present disclosure, compared to those of a conventional PDC fixed blade bit and a conventional roller cone bit.
Figure 4:
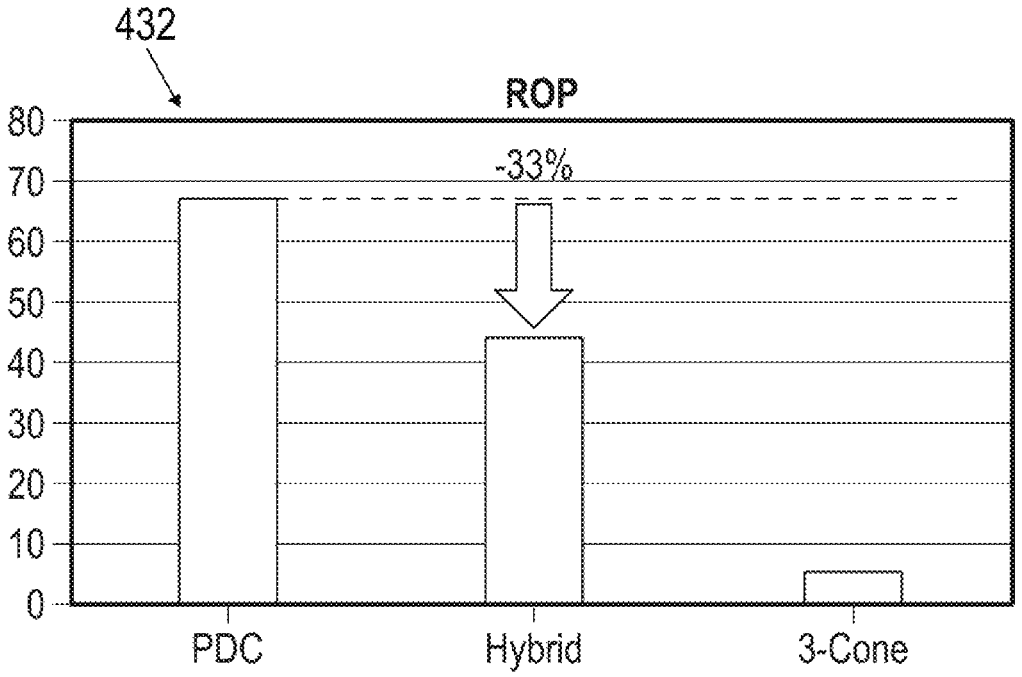
FIG. 4 is a graph of an ROP of a hybrid drill bit, according to at least some embodiments of the present disclosure, compared to those of a conventional PDC fixed blade bit and a conventional roller cone bit for a given rotations per minute (RPM).

FIG. 3 is a graph 332 of a ratio of rate of penetration (ROP) to torque (TQ) for a hybrid drill bit for a given weight on bit (WOB) and rotations per minute (RPM), according to at least some embodiments of the present disclosure, compared to those of a conventional PDC fixed blade bit and a conventional roller cone bit. FIG. 4 is a graph 432 of an ROP of a hybrid drill bit, according to at least some embodiments of the present disclosure, compared to the ROP of a conventional PDC fixed blade bit and the ROP of a conventional roller cone bit for a given WOB and RPM. A conventional roller-cone bit (e.g., a 3-Cone bit was used for testing) demonstrates a relatively high ROP/TQ for a given WOB and RPM, as illustrated in FIG. 3. However, that relatively high ratio is based partially upon the relatively low torque applied by the roller cone bit to the formation, as a roller cone bit transfers weight on bit (WOB) to the formation material more efficiently. As the roller cone bit can rotate on the freely rolling roller cones, the torque applied to the roller cone bit is not transferred to the formation material and does not translate to a high ROP for a given WOB and RPM, as illustrated in FIG. 4.

A conventional PDC drag bit with fixed blades degrades and removes material from the formation by transferring torque applied to the PDC bit directly to the formation material through the cutting elements. In some embodiments, the PDC bit can have a relatively high ROP relative to a given WOB, as illustrated in FIG. 4.

In some embodiments, a hybrid drill bit (such as described in relation to FIG. 2) can degrade the formation with the axial compression forces of the roller cone cutting elements before efficiently removing the degraded material with the shear forces of the fixed blade cutting elements. During testing, a hybrid drill bit with roller cones, according to the present disclosure, can exhibit a greater ROP for a given WOB and RPM than a conventional roller cone bit, while reducing the forces to which the cutting elements are exposed in a conventional PDC bit.

Figure 5:
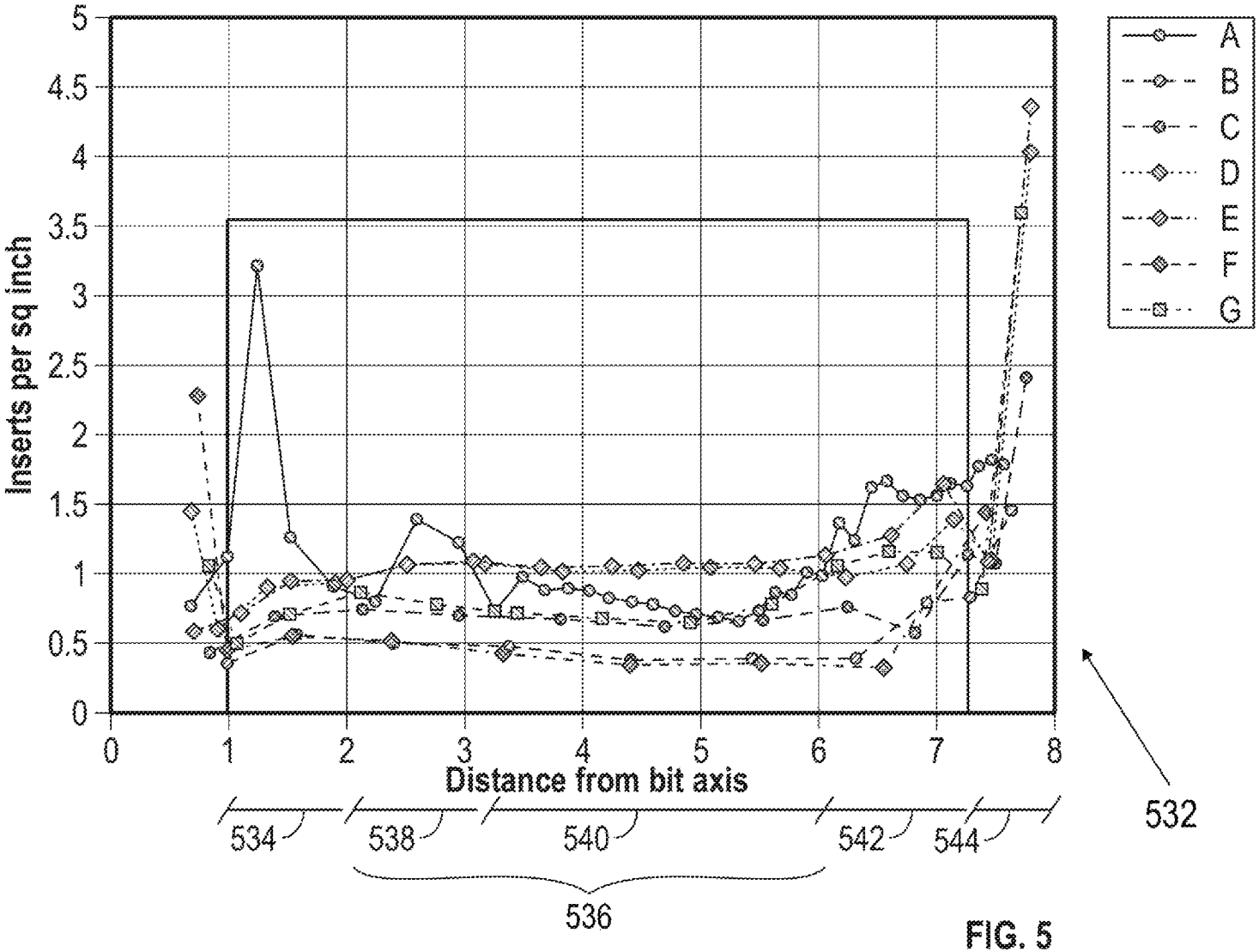
FIG. 5 is a graph illustrating a cutting element density of a roller cone, according to at least some embodiments of the present disclosure, compared to conventional roller cones.

FIG. 5 is a graph 532 illustrating a comparison of cutting element density of a number of different roller cones (A-G) for a 16-inch drill bit (i.e., 8-inch radius), according to at least some embodiments of the present disclosure. For example, in some embodiments, roller cone A can have a cutting profile that exhibits a greater cutting element density in some regions of the cutting profile versus other regions of the cutting profile. In many embodiments, the cutting element density may vary across the profile where some areas have a higher density than others and more specifically within a central region. This illustrates a contrast to the cutting density of the conventional cutting profiles that are substantially constant or consistent across the profile and have higher average cutting element densities near the innermost and outermost regions. For example, in some embodiments, the rolling cone cutting profile has an innermost region 534 proximate to the rotational axis of the drill bit (from 0 to 1 inches in the graph 532). In various embodiments the innermost region may make up 0 to 10% or 10% to 20% or any suitable range of the cutting profile, as will be illustrated further on. In some embodiments, the roller cone cutting profile can include a central region that may be broken or distinguished by one or more regions (536 and 542). As illustrated, some embodiments can have a first central region 536 and a second central region 542 where the first central region may be adjacent to and radially outward from the innermost region 534 (relative to the rotational axis of the bit body) and the second central region may be adjacent to and radially inward from the outermost region 544. In various embodiments, the central region(s) 536 and 542 of the roller cone cutting profile can also include several different zones or sections 538 and 540 each of which can have a distinct cutting element density. As can be appreciated, the central regions may be dispersed and/or configured in any number of ways and the density of cutting elements can vary across the various regions.

As previously discussed, many embodiments of the roller cone cutting profile may include an outermost region 544 adjacent to and radially outward from a second central region 542 (relative to the rotational axis of the bit body). In various embodiments, the outermost region can make up any suitable range of the cutting profile moving radially outward from the rotational axis of the bit body that may be 90 to 100% or 80% to 100% or any range therein. Likewise, the central region(s) may make up the remainder of the cutting profile between the innermost and outermost regions. For example, some embodiments of the central region(s) may range between 10 to 90%, or 20 to 80% or 20 to 90% or 25 to 75% or any suitable range therein.

As described herein, the second central region 542 can experience the highest torque per cutting element in a conventional drag bit. An increase in cutting element density in the second central region 542, in some embodiments, can therefore degrade the formation material proximate to the second central region 542 more, thereby reducing the torque on the fixed blade cutting elements in the second central region 542. In various embodiments, the roller cone can have a cutting element density in the second central region 542 that may be no less than 75% greater than a cutting element density in the first central region 536. In some embodiments, the roller cone has a cutting element density in the second central region 542 that may be no less than 150% greater than a cutting element density in the first central region 536. As can be appreciated, cutting element density can vary between regions in any suitable configuration such that the roller cone and overall bit cutting profile can be optimized for the specific formation.

Cutting element density is a quantity of cutting elements per square inch of roller cone surface and/or the outer perimeter of the cutting profile in the region. As used herein, a cutting element density for a region, in some embodiments, is an average cutting element density for the region and/or zone. In some embodiments, the cutting elements may be distributed substantially equally throughout the region. In numerous embodiments, the cutting elements may be arranged with areas of greater or less cutting element density within a region and/or between different zones. When comparing relative cutting element densities between regions, the values are the average cutting element density for the region unless otherwise noted. In some embodiments, the location of the cutting element may be determined by the location of a center axis of the cutting element at the roller cone surface and/or the cutting profile formed by the composite of the cutting elements.

In some embodiments, the roller cone can have a cutting element density in the innermost region 534 that may be no less than 75% greater than a cutting element density in the first central region 536. In some embodiments, the innermost region 534 may contain comparatively few fixed blade cutting elements, such as illustrated in the embodiment of FIG. 2, and an increase in cutting element density in the innermost region 534 of the roller cone cutting profile can improve degradation and removal of formation material proximate the cone of the drill bit. Furthermore, many embodiments may incorporate numerous cutting elements within the innermost region such that a drill bit, hybrid or otherwise, may be configured to have a roller cone cutting element closest to the rotational axis of the bit.

In various embodiments, a first inner central zone 538 may have a cutting element density no less than 50% more than that of an outer first central zone 540. The inner first central zone 538 and the outer first central zone 540 may, in some embodiments, be associated with the arrangement of fixed blade cutting elements on the primary blade and the secondary blade of a hybrid drill bit, as will be described in more detail in relation to FIG. 7. In some embodiments, the cutting element density immediately adjacent to the rotational axis of the drill bit and in the outermost region 544 may exhibit a pronounced increase in cutting element density relative to a distance from the rotational axis of the drill bit (as in the graph 532) because the orientation of the surface of the roller cone or fixed blade supporting the cutting elements changes relative to the radial direction.

Figures 2, 6:
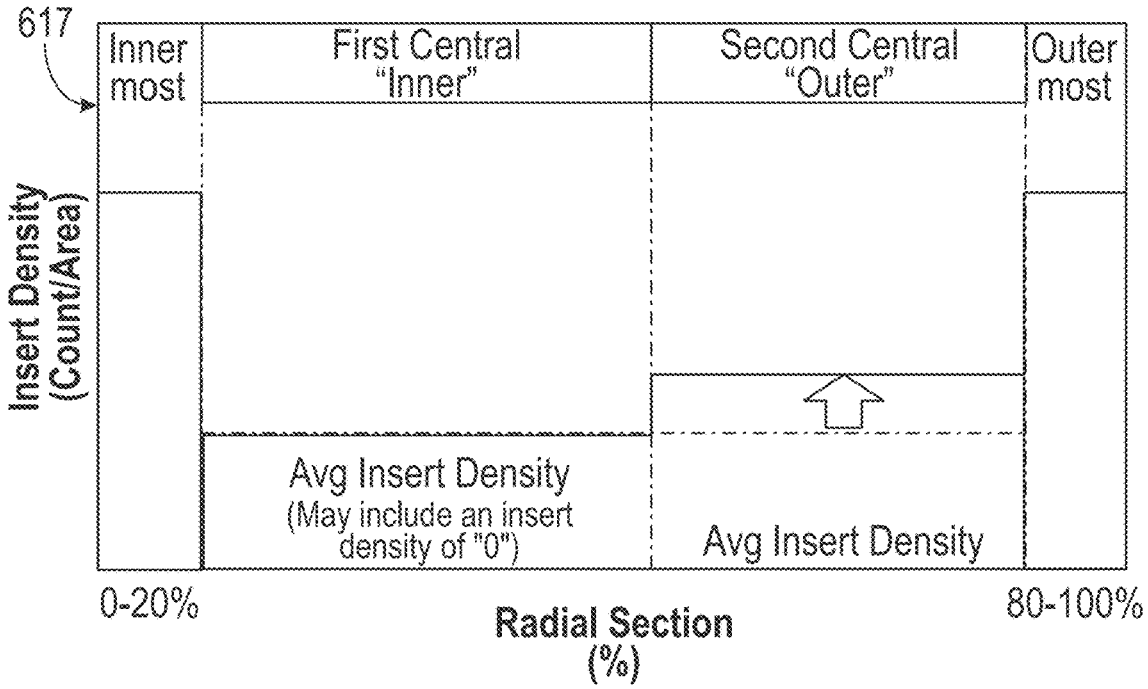
Figures 3, 6:
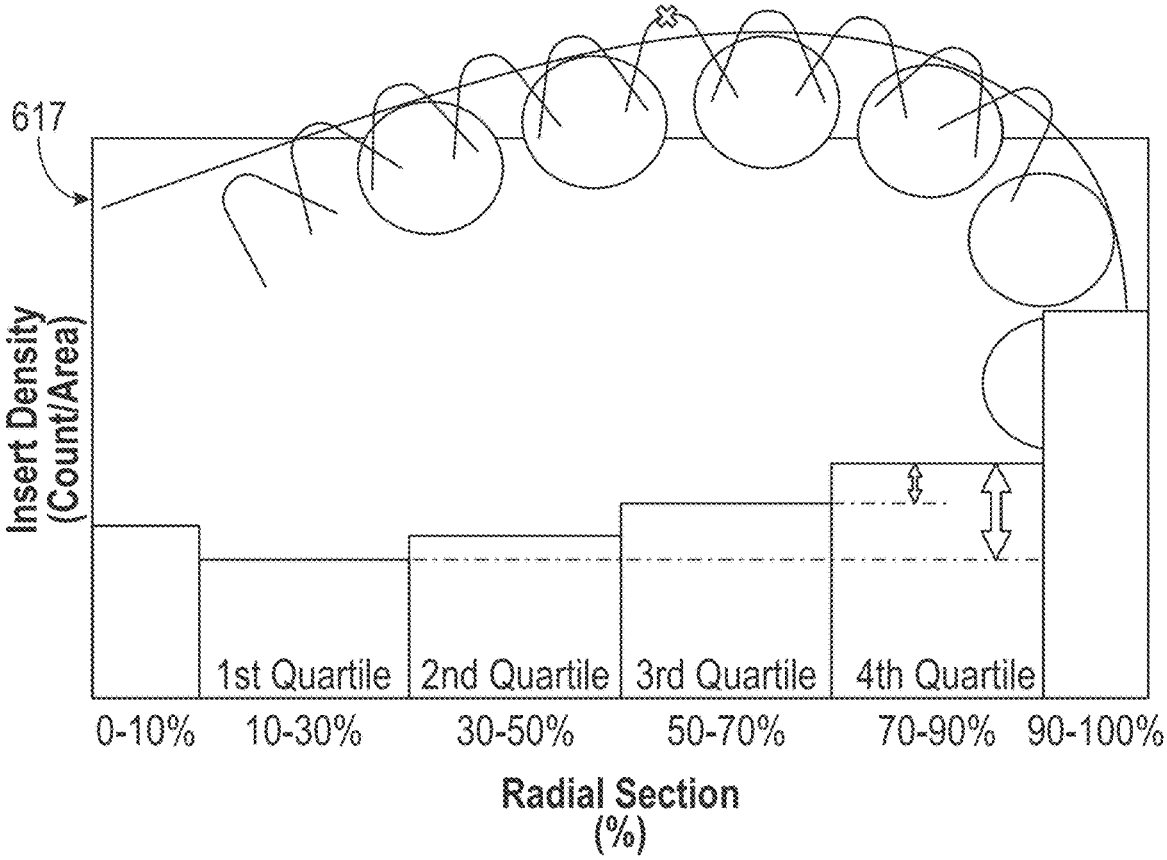
Figures 4, 6:
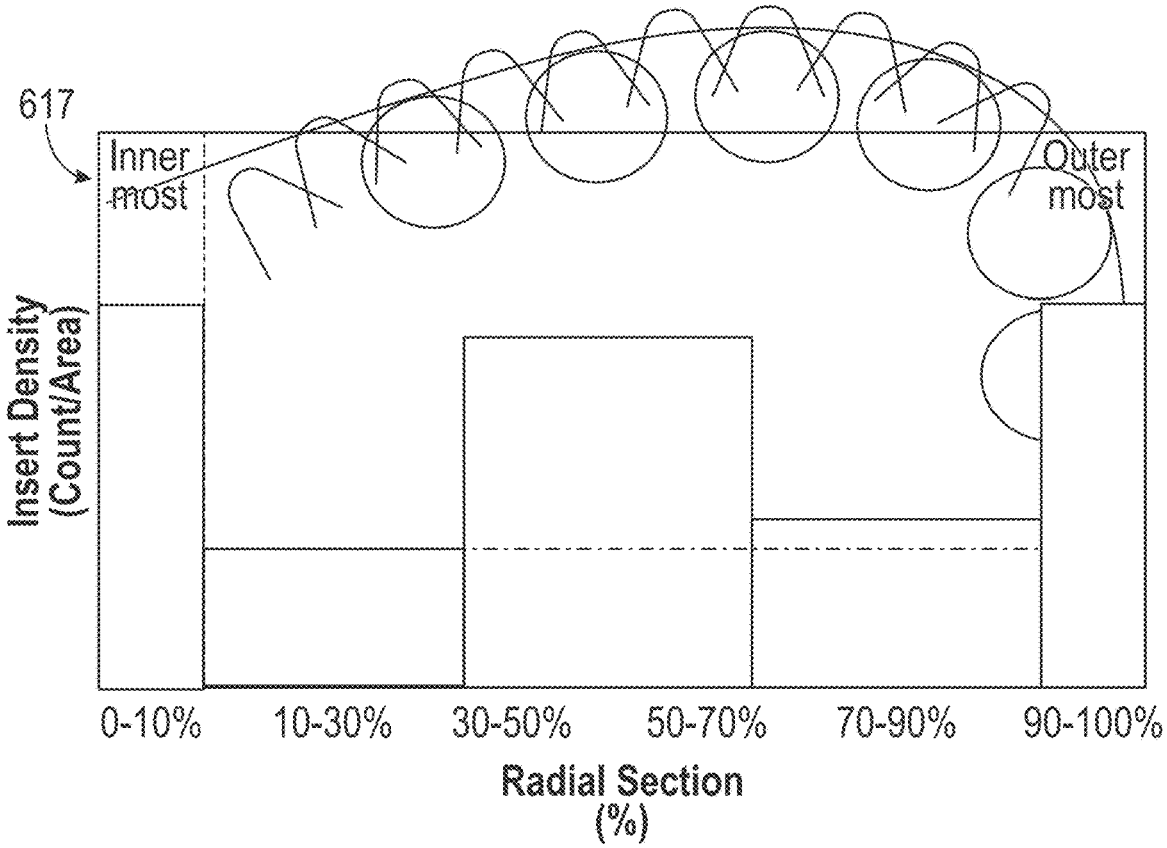
Figures 5, 6:
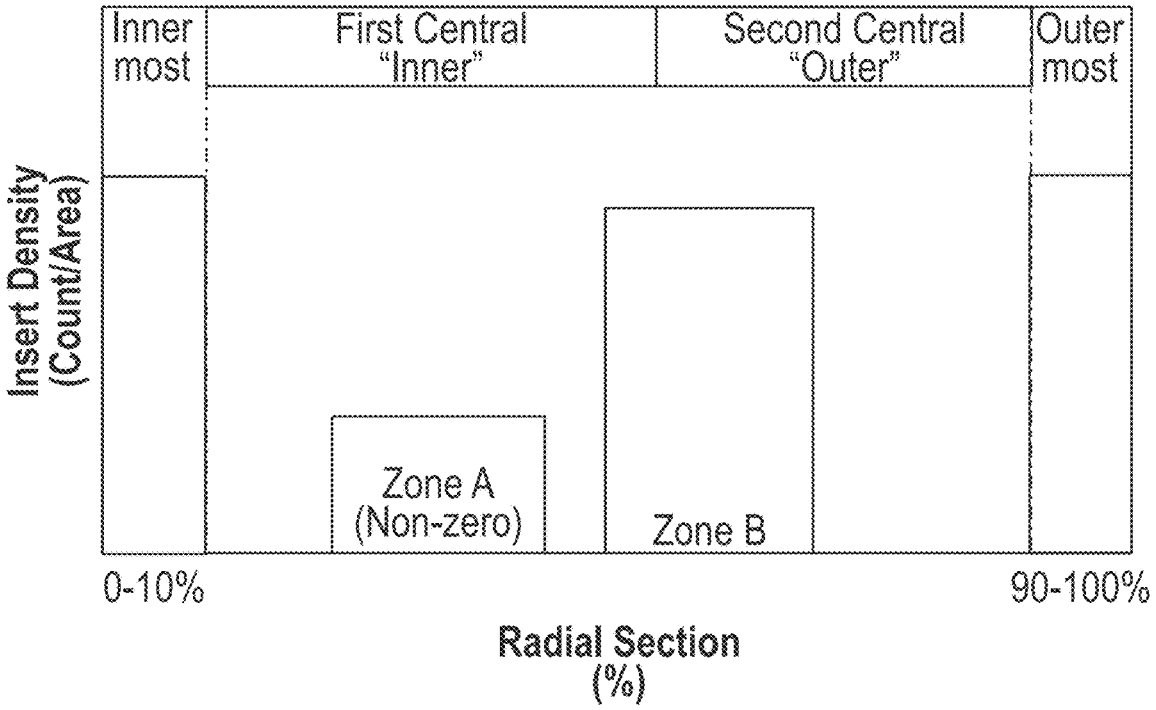

FIG. 6-1 illustrates a cutting profile of various embodiments of a roller cone, according to present disclosure. The cutting profile is a composite overlay of the location and geometry of the cutting elements of a drill bit rotated into a single plane around a cone axis and can be an overlay of the location and geometry of the cutting elements of a roller cone. The cutting profile illustrates the position of the cutting elements of the cone exposed to the formation surface during a complete rotation of the roller cone.

Similar to the graph illustrated in FIG. 5, various embodiments of a rolling cone cutting profile can have an innermost region 634 proximate to the rotational axis 617 of the drill bit. In some embodiments, the roller cone cutting profile can include a central region that can have a first central region 636 and a second central region 642. In various embodiments, the first central region can be adjacent to and radially outward from the innermost region 634 (relative to the rotational axis 617 of the bit body). In many embodiments, second central region 642 may be adjacent to and radially outward from the first central region 636 (relative to the rotational axis 617 of the bit body). In some embodiments, the roller cone cutting profile may also include an outermost region 644 adjacent to and radially outward from the second central region 642 (relative to the rotational axis 617 of the bit body).

In various embodiments, the regions may be defined by the location of the cutting elements in the radial direction. The radial direction may be perpendicular to the rotational axis of the drill bit. In some embodiments, the innermost region 634 may be the portion of the cutting profile that makes up or is within the nearest 10 to 20% of the cutting profile to the rotational axis in the radial direction. In some embodiments, the first central region 636 and the second central region 642 may make up a portion of the cutting profile between 10% and 90% of the cutting profile in the radial direction. In other embodiments, the first and second central regions may make up a portion of the cutting profile between 20% and 80% or 25% and 75% or any range therein. As can be appreciated, various embodiments may be configured such that each of the first and second central regions make up portions of the 10% to 90%, 20% to 80%, or 25% to 75%, or any combination thereof of the cutting profile. Additionally, in various embodiments, the size of each of the first and second central regions may or may not be equal and may have one or more zones (638 and 640) within each of the respective regions. For example, the first central region may be the portion of the cutting profile between 10% and 75% or 20% and 75% of the cutting profile in the radial direction or may be 20% to 50% or 20% to 30%. In other embodiments, the second central region 642 may be the portion of the cutting profile between 75% and 95% of the cutting profile in the radial direction or may be 30% to 90% or may be 50% to 90%. In some embodiments, the outermost region 644 may be the portion of the cutting profile between 90% and 100%, 80% and 100%, or 95% and 100% or any range therein of the cutting profile in the radial direction.

While the above percentile ranges are described in relation to the embodiment illustrated in FIG. 6-1 and similar embodiments, it should be understood that such percentile ranges are not fully illustrative of all embodiments. For example, in other embodiments, such as illustrated in FIG. 6-2, the regions can have other percentile ranges relative to the rotational axis 617 of the drill bit. In some embodiments, the cutting profile of the roller cone can have an inner region and an outer region, wherein the inner region has a lower cutting element density than the outer region. In some embodiments, the inner region may be the portion of the cutting profile adjacent to the rotational axis 617 up to and including 30%, 40%, 50%, 60%, or 70% of the cutting profile in the radial direction away from the rotational axis 617.

In some embodiments, the outer region may be the remaining portion of the cutting profile radially outward from the inner region. In some embodiments, the outer region may be the remaining portion of the cutting profile radially outward from the inner region except for the final 10% to 20% of the radial distance (i.e., 90% to 100% or 80% to 100%) of the roller cone cutting profile. In some embodiments, this outermost region may correspond to an outermost surface of the roller cone on which different cutting elements are used and/or does not substantially contribute to a downhole ROP of the roller cone and/or drill bit. The cutting element density may be calculated within an innermost region and the outermost region relative to a rotational axis 617 of the drill bit that may not substantially contribute to the downhole ROP of the roller cone and/or drill bit. In some embodiments, the innermost region (e.g., core) may be between 10-20% of the radial length of the roller cone length. In some embodiments, the outermost region may be the final between 10-20% of the radial length of the roller cone length. In some embodiments, the outer region has a greater cutting element density than the inner region by at least 75%. In some embodiments, the outer region has a greater cutting element density than the inner region by at least 150%.

In some embodiments, the cutting element density can vary across the cutting profile by 4 or more regions. For example, in some embodiments, a first region may be the portion of the cutting profile adjacent to the rotational axis 617 up to and including 20% of the cutting profile in the radial direction away from the rotational axis 617, a second region may be the portion of the cutting profile adjacent to the first region (i.e., 25%) up to and including 50% or more of the cutting profile in the radial direction away from the rotational axis 617, a third region may be the portion of the cutting profile adjacent to the second region (i.e., 50%) up to and including 80% or up to 90% of the cutting profile in the radial direction away from the rotational axis 617, and a fourth region may be the portion of the cutting profile adjacent to the third region (i.e., 75%) up to and including 100% of the cutting profile in the radial direction away from the rotational axis 617. In some embodiments, the third region may have a greater cutting element density than the second region by at least 75%. In other embodiments, the third region may have a greater cutting element density than the second region by at least 150%. In some embodiments, the fourth region may have a greater cutting element density than the third region by at least 75%. In some embodiments, the fourth region may have a greater cutting element density than the third region by at least 150%.

In numerous embodiments, the cutting element density may vary across the cutting profile and across different zones or regions. For example, some embodiments may have 4 equal zones (i.e., quartiles) as shown in FIG. 6-3. For example, the remaining cutting profile may be considered in quartiles or 4 equal sections, zones, or regions from 10% or 20% of the radial distance of the cutting profile up to 90% of the cutting profile. In some embodiments, a first region may be the portion of the cutting profile from 10% or 20% up to and including 30% of the cutting profile in the radial direction away from the rotational axis 617, a second region may be the portion of the cutting profile adjacent to the first region (i.e., 30%) up to and including 50% of the cutting profile in the radial direction away from the rotational axis 617, a third region may be the portion of the cutting profile adjacent to the second region (i.e., 50%) up to and including 70% of the cutting profile in the radial direction away from the rotational axis 617, and a fourth region may be the portion of the cutting profile adjacent to the third region (i.e., 70%) up to and including 90% of the cutting profile in the radial direction away from the rotational axis 617.

In numerous embodiments, the third region may have a greater cutting element density than the second region by at least 75%. In various embodiments, the third region may have a greater cutting element density than the second region by at least 150%. In other embodiments, the fourth region may have a greater cutting element density than the third region by at least 75%. In some embodiments, the fourth region may have a greater cutting element density than the third region by at least 150%. As can be appreciated, many embodiments may incorporate cutting element densities that vary between any of the two quartiles. For example, the third quartile may have a greater cutting element density than the first, second or fourth quartile and may be greater than at least 75% or more than 150%.

FIG. 6-4, for example, is a graph illustrating a cutting profile cutting element density in accordance with various embodiments. In some embodiments, the central region i.e. 10% or 20% to 80% or 90% of the cutting profile can be divided into three sections, zones, or regions; each having a specific cutting element density. The cutting element density in each of the sections, zones, or regions can vary such that one section, zone, or region may have a higher density than the other two. As can be appreciated the average cutting element density can be adjusted from region to region depending on the formation that is to be cut by the cutting elements. Additionally, the average cutting element density can be calculated over the various sections, zones, or regions.

FIG. 6-5 is a graph illustrating cutting element density for an embodiment of a roller cone. In some embodiments, the cutting element density may vary between two zones of the radial length of the roller cone. In some embodiments, the cutting element density may be calculated by regions of at least 20% of the radial length of the roller cone (such as the regions described in relation to FIG. 6-3 or 6-4) within an innermost region 634 and the outermost region 644 relative to a rotational axis 617 of the drill bit. In some embodiments, the innermost region 634 and the outermost region 644 do not substantially contribute to the downhole ROP of the roller cone and/or drill bit. In various embodiments, the innermost region 634 may be about 10% of the radial length of the cutting profile. In some embodiments, the innermost region 634 may be about 20% of the radial length of the cutting profile. In some embodiments, the innermost region 634 may be between 10% and 20% or 0% and 20% of the radial length of the cutting profile. In some embodiments, the outermost region 644 may be about 10% or 90% to 100% of the radial length of the cutting profile. In some embodiments, the outermost region 644 may be about 20% or 80% to 100% of the radial length of the cutting profile. In some embodiments, the outermost region 644 may be between 10% and 20% of the radial length of the cutting profile. For example, the at least 20% regions in the remaining cutting profile may be located in the center portion from 10% of the radial distance of the cutting profile to 90% of the cutting profile.

In other embodiments, a first central or inner region may be the portion of the cutting profile from 10% up to and including 30% of the cutting profile in the radial direction away from the rotational axis 617, and a second central or outer region may be the portion of the cutting profile adjacent to the first region from 70% to and including 90% of the cutting profile in the radial direction away from the rotational axis 617. In some embodiments, a first zone (e.g., Zone A of FIG. 6-5) may be the portion of the cutting profile from 20% up to and including 40% of the cutting profile in the radial direction away from the rotational axis 617 or may be just a portion thereof and may not consume the entire range. In some embodiments, a second zone (e.g., Zone B of FIG. 6-5) may be the portion of the cutting profile located within the first and or second central regions and may make up from 45% to and including 70% of the cutting profile in the radial direction away from the rotational axis 617 or may make up just a portion thereof. In some embodiments, a first region may be the portion of the cutting profile from 60% to and including 88% of the cutting profile in the radial direction away from the rotational axis 617, and a second region may be the portion of the cutting profile adjacent to the first region from 28% up to and including 54% of the cutting profile in the radial direction away from the rotational axis 617. It should be readily appreciated, that the different zones can make up any combination of percentage of the cutting profile that is suitable for the intended purpose. As may also be appreciated, various embodiments may incorporate adjacent zones between the cutting zones that have zero cutting elements disposed therein. Furthermore, the various zones may be configured to be positioned at any given location within the first and/or central regions.

In some embodiments, a first zone may have a greater cutting element density than the second zone or any adjacent zone by at least 75%. In some embodiments, the first zone may have a greater cutting element density than the second zone or any adjacent zone by at least 150%. In some embodiments, the second zone may have a greater cutting element density than the first zone by at least 75%. In some embodiments, the second zone may have a greater cutting element density than the first zone by at least 150%. In some embodiments, the zones defined in the radial direction may have a non-zero cutting element density. For example, a first zone with a non-zero cutting element density may have at least a 75% greater cutting element density than a second zone with a non-zero cutting element density.

In numerous embodiments, the cutting elements may be different between at least two of the regions. For example, in some embodiments, the cutting elements in the first central region 636 and the cutting elements in the second central region 642 may be different. In other embodiments, the cutting elements in the first central region 636 and the cutting elements in the innermost region 634 may be different.

In various embodiments, the cutting elements may vary between regions in composition. For example, the cutting elements in the first central region 636 may be or include diamond and the cutting elements in the second central region 642 may be or include a carbide, such as tungsten carbide. In other embodiments, the cutting elements may vary between regions in toughness. For example, the cutting elements in the first central region 636 may have a greater toughness than the cutting elements in the innermost region 634. In some embodiments, the cutting elements may vary between regions in hardness. For example, the cutting elements in the first central region 636 may have a greater toughness than the cutting elements in the second central region 642. In some embodiments, the cutting elements may vary between regions in diameter. In some embodiments, the cutting elements may vary between regions in depth of cut and/or height of the cutting element above the roller cone surface. In various embodiments, the cutting elements may vary between regions in geometry. For example, the cutting elements in the innermost region 634 may be or include ridge or chisel cutting elements and the cutting elements in the first central region 636 may be or include conical cutting elements. In another example, the cutting elements in the second central region 642 may be or include conical cutting elements and the cutting elements in the first central region 636 may be or include bullet cutting elements. As can be appreciated, various embodiments may include cutting elements that vary in shape, size, material, hardness or any combination thereof. Additionally, it should be appreciated that various embodiments may include any variation of cutting elements within the various cutting regions. For example, some embodiments may have diamond cutting elements in one region and carbide elements in another region that may be adjacent to the diamond cutting elements. In some embodiments, the cutting regions may also include a mix of cutting elements that can include a mix between diamond and/or carbide elements.

Figure 7:
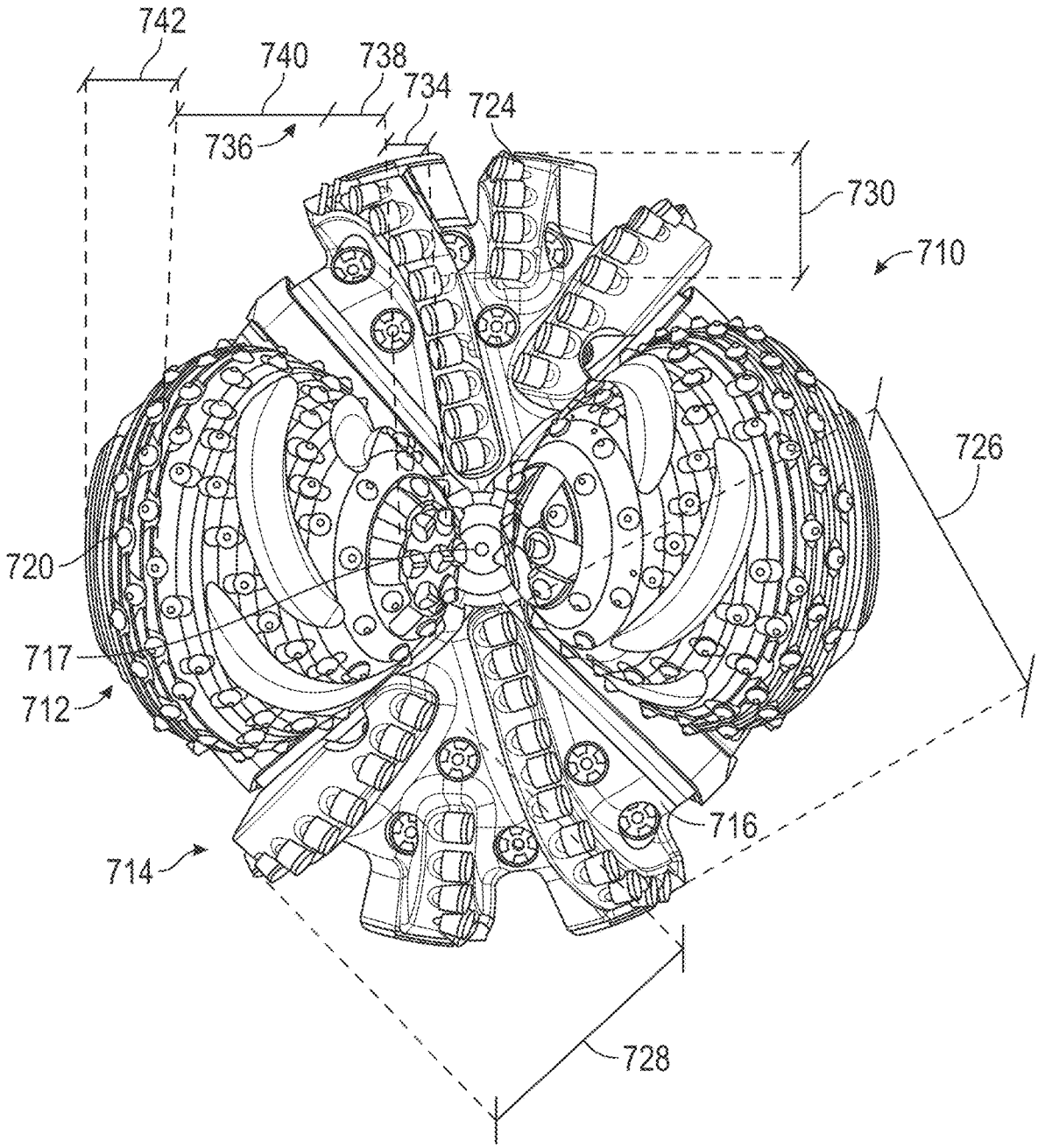
FIG. 7 illustrates bottom view of an embodiment of a hybrid drill bit comparing radial positions of roller cone cutting elements on the roller cone(s) and the fixed blade cutting elements on the fixed blade(s) relative to a rotational axis of the bit body, according to at least some embodiments of the present disclosure.

FIG. 7 is a bottom view of an embodiment of a hybrid drill bit 710 comparing radial positions of roller cone cutting elements on the roller cone(s) 712 and the fixed blade cutting elements on the fixed blade(s) 714 relative to a rotational axis 717 of the bit body 716. In some embodiments, the roller cone 712 may have at least an innermost region 734, a first central region 736, and a second central region 742. In some embodiments, the first central region 736 may include an inner first central region 738 and an outer first central region 740. In various embodiments, the regions of the roller cone 712 and the roller cone cutting elements 720 may be at least partially related to the locations and/or arrangements of the fixed blade cutting elements 724 on the fixed blades 714.

In some embodiments, a radial position (relative to the rotational axis 717) of the radially innermost fixed blade cutting element 724 of the primary blade 726 may corresponds to the transition from the innermost region 734 to the first central region 736. For example, the fixed blade cutting elements 724 of the primary blade 726 may radially overlap the first central region 736 and the second central region 742 of the roller cone 712. In other embodiments, a radial position (relative to the rotational axis 717) of the radially innermost fixed blade cutting element 724 of the secondary blade 728 may correspond to the transition from the inner first central region 738 to the outer first central region 740. For example, the fixed blade cutting elements 724 of the secondary blade 728 may radially overlap the outer first central region 740 and the second central region 742 of the roller cone 712. In some embodiments, a radial position (relative to the rotational axis 717) of the radially innermost fixed blade cutting element 724 of the tertiary blade 730 may correspond to the transition from the first central region 736 to the second central region 742. For example, the fixed blade cutting elements 724 of the tertiary blade 730 may radially overlap the second central region 742 of the roller cone 712.

Figures 1, 8:
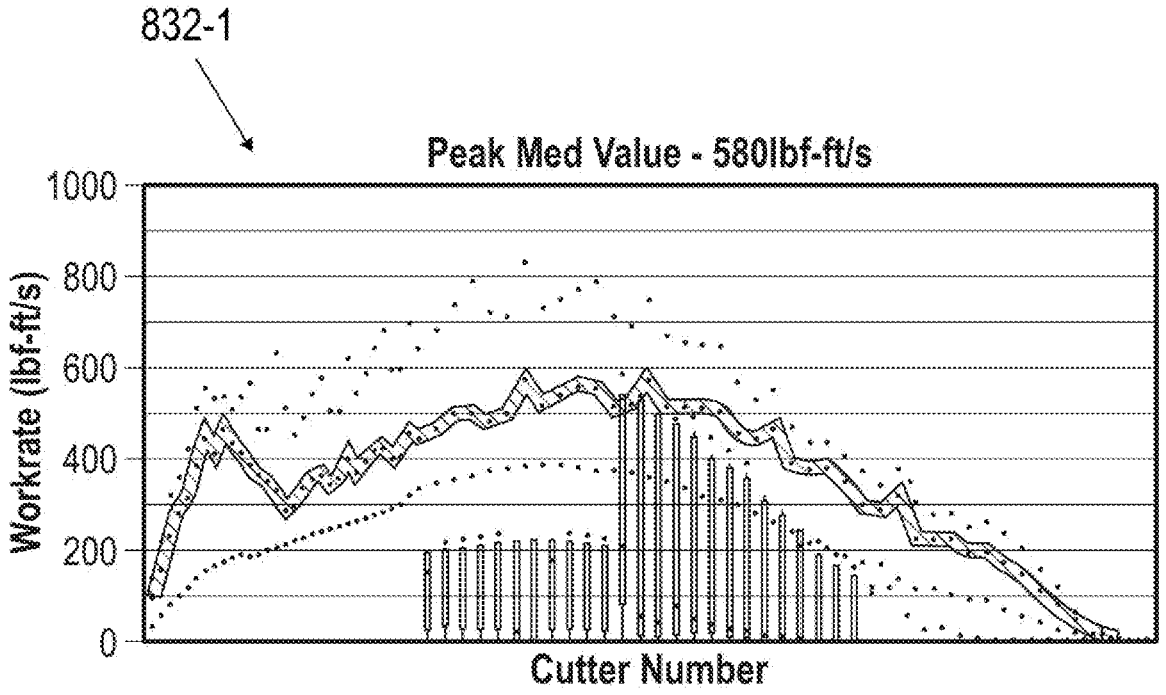
Figures 2, 8:
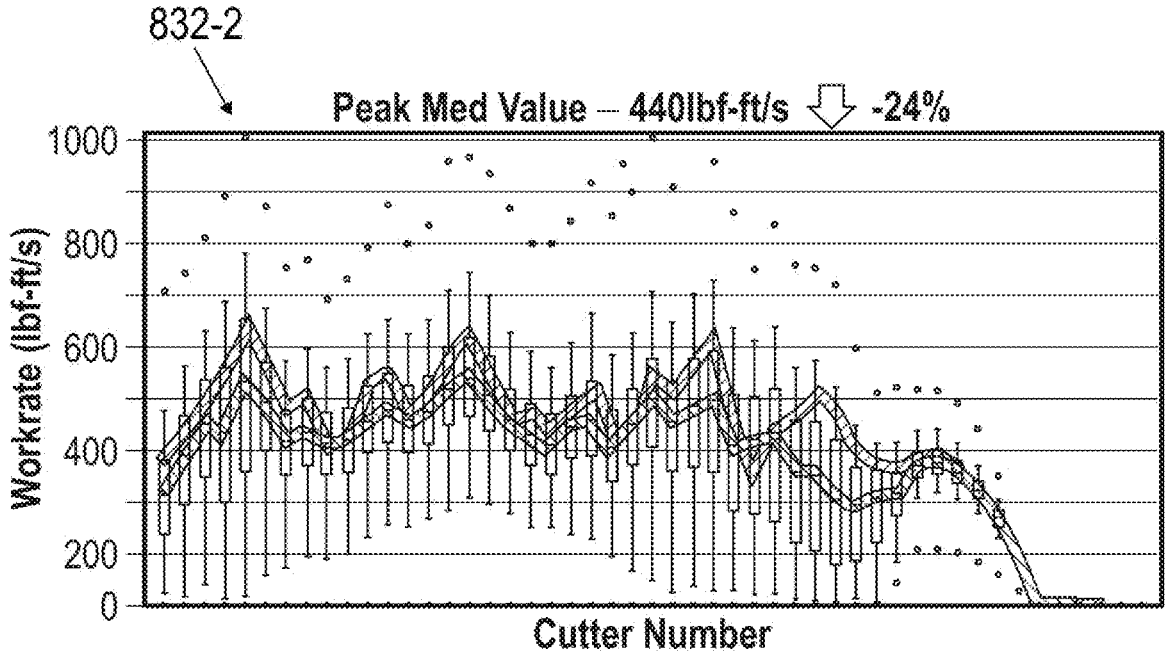

FIG. 8-1 is a graph 832-1 illustrating testing data of work rates of individual cutting elements from a conventional fixed blade drill bit. In some embodiments, the fixed cutting elements in the cutting profile (such as a cutting profile described in relation to FIG. 6) may be designated by a cutting element number in sequence relative to the rotational axis of the drill bit. At a measured ROP, the force on each cutting element may be measured. A torque applied to the bit by each cutting element (based at least partially on the measured force at each cutting element) is plotted in the graph normalized by the ROP.

FIG. 8-2 is a graph 832-2 illustrating testing data of work rates of individual cutting elements from a hybrid drill bit, according to at least some embodiments of the present disclosure. In some embodiments, the fixed cutting elements in the cutting profile (such as a cutting profile described in relation to FIG. 6) may be designated by a cutting element number in sequence relative to the rotational axis of the drill bit. At a measured ROP, the force on each cutting element is measured. A torque applied to the bit by each cutting element (based at least partially on the measured force at each cutting element) is plotted in the graph normalized by the ROP between FIG. 8-1 and FIG. 8-2. In some embodiments, a hybrid bit with a roller cone according to the present disclosure may reduce the peak median torque experienced by the cutting elements in the composite cutting profile of the drill bit during testing, allowing each cutting element to bear a more consistent force and more efficiently remove material from the formation at a given WOB.

Figure 9:
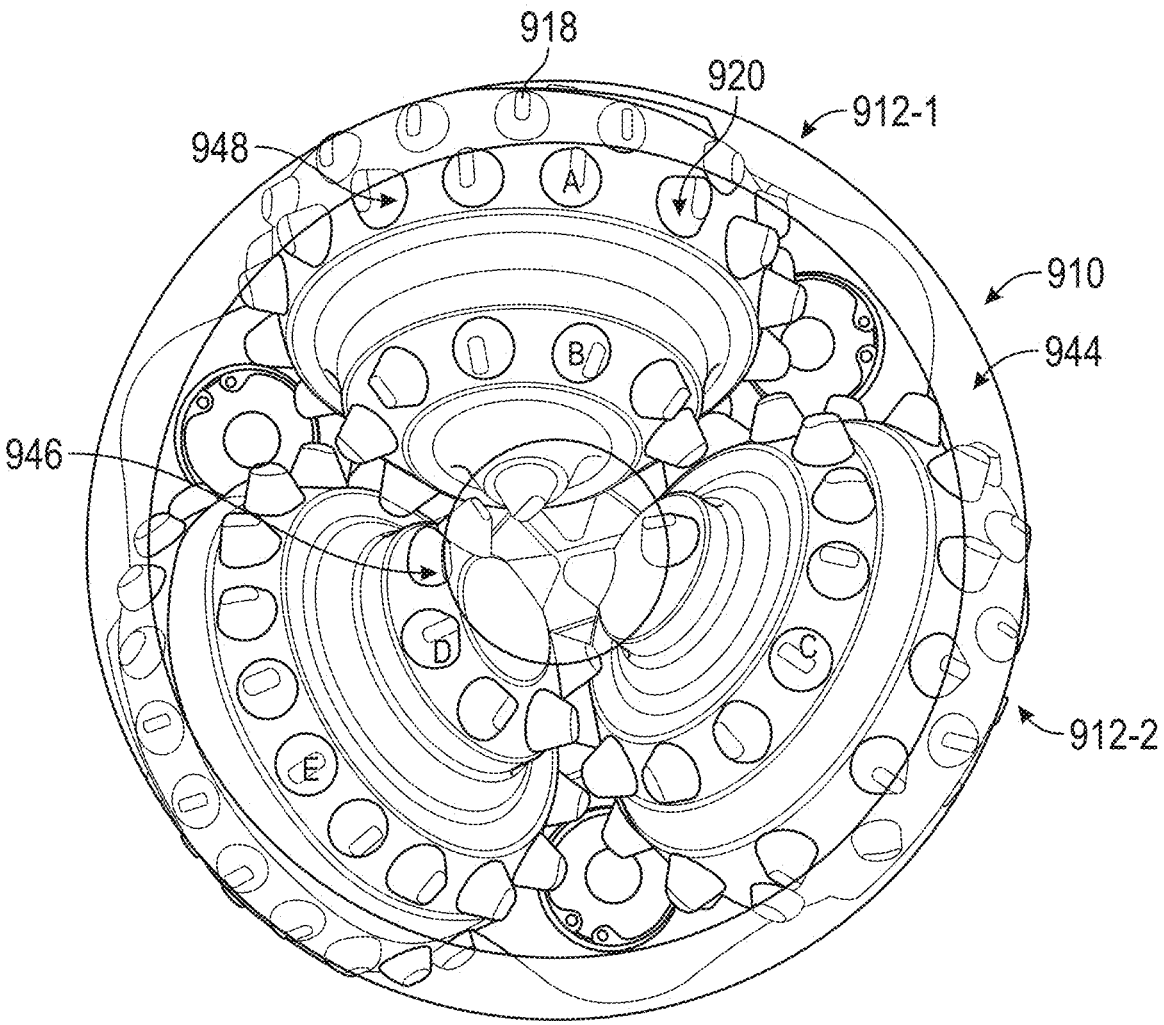
FIG. 9 illustrates a bottom view of a roller cone bit with rows of cutting elements, according to at least some embodiments of the present disclosure.

FIG. 9 is a view of an embodiment of a drill bit 910 with a roller cone 912-1, 912-2 having a plurality of rows of cutting elements positioned on the roller cone. In some embodiments, a row 948 may be a substantially concentric ring of cutting elements 920 oriented on the roller cone perpendicular to the cone axis 918. For example, each cutting element in a row may overlap as the roller cone rotates around the cone axis and contribute to the same location in the cutting profile. In some embodiments, each row may have a fixed or constant radial position that allows the rows to intermesh between roller cones 912-1, 912-2 on a drill bit 910. In the illustrated embodiment of FIG. 9, Row A and Row B of the first roller cone 912-1 may have a substantially constant radial position on the cutting profile, allowing Row C of the second roller cone 912-2 to intermesh with Row A and Row B. In some embodiments, a row 948 may be located between the innermost portion 946 and the outermost portion 944 of the roller cone and/or drill bit and no cutting elements of the row (a first row or an adjacent row) may be located in the innermost region or outermost region. In some embodiments, the innermost region and outermost region may be the portions of the cone cutting profile within 10% to 20% of the ends of the cone cutting profile, as described herein.

Figure 10:
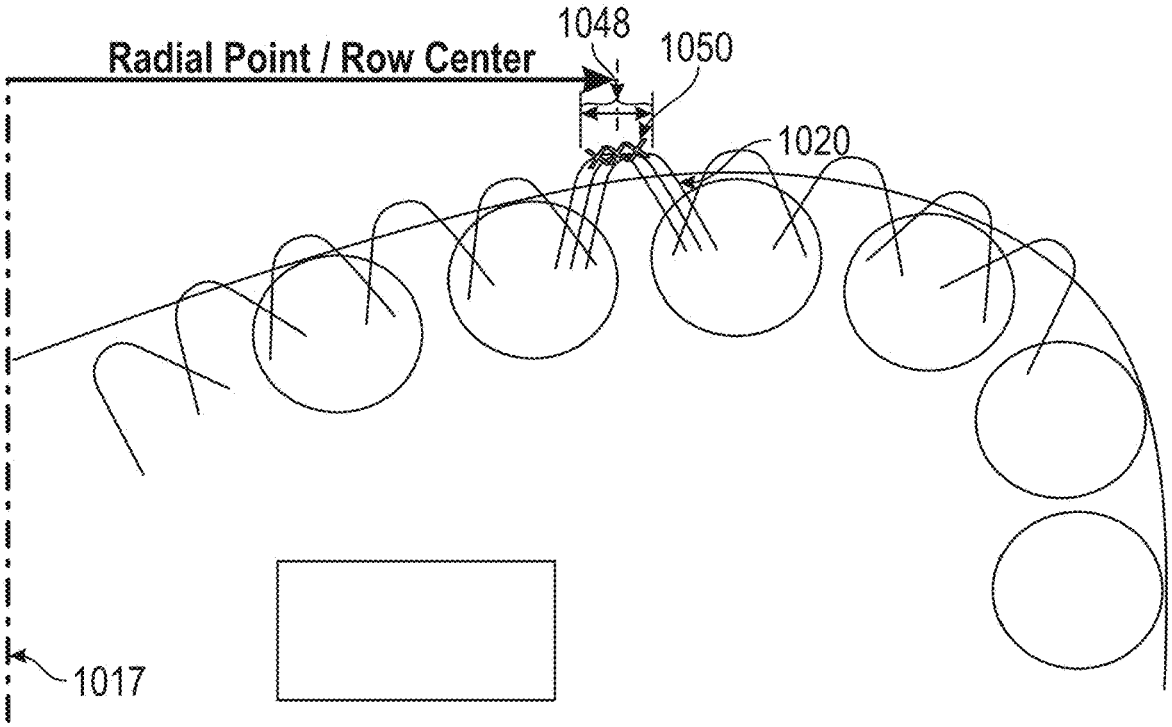
FIG. 10 illustrates a partial cutting profile of a roller cone illustrating a row of cutting elements, according to at least some embodiments of the present disclosure.

Referring now to FIG. 10, a row 1048 may be, in some embodiments, a plurality of cutting elements 1020 that fall within a 0.5-inch radial distance region relative to the rotational axis 1017 of the bit and/or the radially innermost point of the cone. For example, a cutting element 1020 may be in a row 1048 with any other cutting elements having a center axis 1050 within 0.25 inches of the center axis 1050 of the cutting element 1020 in either radial direction of the roller cone. In some embodiments, a region in the radial direction that includes no cutting elements (i.e., has a zero cutting element density) may be not considered a row, as it lacks any cutting elements.

In some embodiments, a first row may have a cutting element density that may be at least 75% greater than an adjacent row. In some embodiments, a first row may have a cutting element density that may be at least 150% greater than an adjacent row. In some embodiments, an adjacent row may be a second row that may be less than 0.5 inches from the first row in the radial direction. In some embodiments, an adjacent row may be a second row that may be less than 0.5 inches from the first row in the radial direction with no cutting elements positioned radially therebetween. In some embodiments, a second row may be adjacent to a first row on the same roller cone. In some embodiments, a second row may be adjacent to a first row on drill bit cutting profile. For example, the second row may be adjacent to a first row on a different roller cone of the same drill bit when the cutting elements of the drill bit (e.g., including a plurality of roller cones) are rotated into a single plane.

Figure 11:
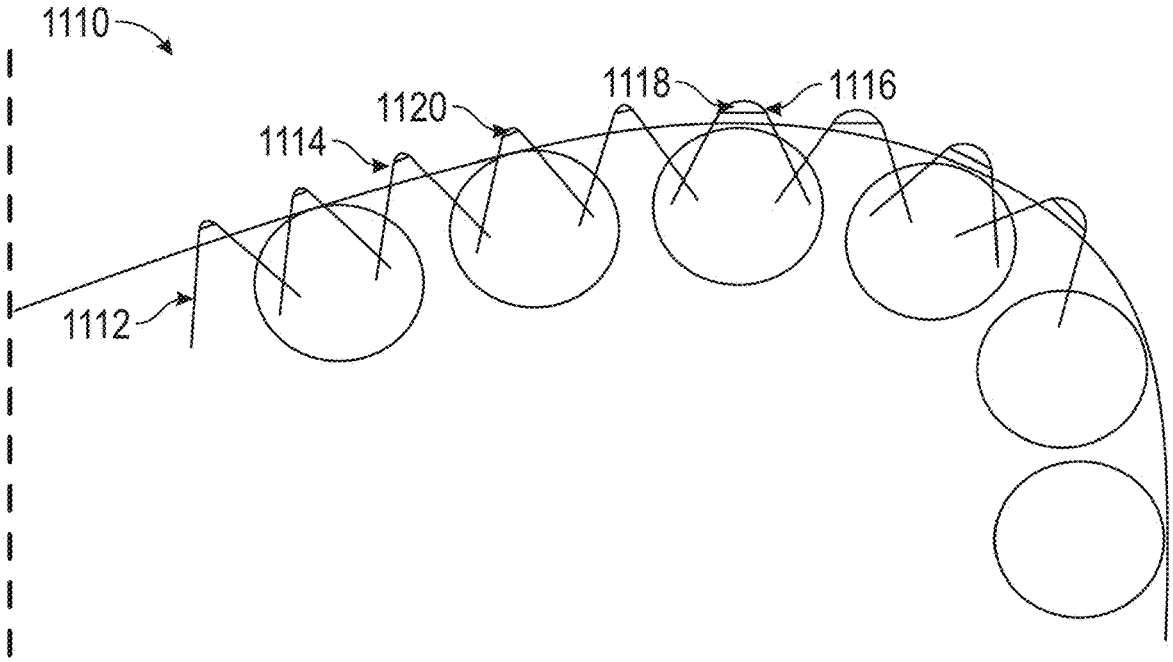
FIG. 11 illustrates a profile of a roller cone in accordance with embodiments.

Moving now to FIG. 11, an embodiment of a cutting profile 1110 in accordance with various embodiments. As has been thoroughly discussed, many embodiments of a cutting profile can have a varied cutting element density to help improve the cutting capabilities of a drill bit. In some embodiments, the cutting elements 1112 may have varying tip radii. For example, some cutting elements 1112 may have a first tip radius 1114 that is smaller than a second tip radius 1116. Additionally, and currently, some embodiments may have cutting elements 1112 that have a tip volume 1118 that is larger or smaller than a second tip volume 1120. As can be appreciated, cutting elements 1112 that have a varied tip radius and/or tip volume may increase the insert loading in a specific zone or region of the cutting profile. Additionally, some embodiments may have a varied toughness and/or stiffness between cutting elements that can aid in the insert loading of the drill bit. In some embodiments, the cutting element hardness in one zone may be higher than in another zone. In other embodiments, the cutting element toughness in one zone may be higher or lower than in another zone.

In some embodiments, drill bits with a roller cone according to the present disclosure reduce the torque experienced by the cutting elements in the composite cutting profile of the drill bit, allowing each cutting element to bear a more consistent force and more efficiently remove material from the formation. Furthermore, as can be appreciated, roller cones and/or bits described herein can allow for cones and/or bits to cut the innermost region of a downhole more efficiently and improve the overall function of the bit and process of drilling a hole based on the configuration of the cutting element density within the roller cone and/or bit.

Industrial Applicability

Embodiments of the present disclosure generally relate to devices, systems, and methods for drilling in an earth formation. More particularly, some embodiments of the present disclosure relate to hybrid drill bits for degrading and/or removing material from the earth formation. In some embodiments, a drill bit includes a roller cone and a fixed blade in sequence to crack, crush, deform, or otherwise degrade the material of the earth formation before removing the degraded material. In some embodiments, the roller cone rolls across a surface of the formation material of the earth formation to apply a compression force and/or a shear force to degrade the formation material into a degraded material, and the fixed blade drags across or through the degraded material to remove at least a portion of the degraded material.

In some embodiments, a drill bit according to the present disclosure includes a bit body with a rotational axis. The roller cone may be supported by the bit body and rotatable around a cone axis that may be oriented substantially radially to the rotational axis of the bit body, such that the roller cone rotates around the cone axis while the bit body rotates around the rotational axis. In some embodiments, the drill bit further includes a fixed blade that may be fixed relative to and/or integrally formed with the bit body. The roller cone and the fixed blade each include a plurality of cutting elements affixed thereto.

In some embodiments, the roller cone has a plurality of regions in the axial direction of the cone axis (i.e., the axis around which the roller cone rotates as the bit body rotates around the rotational axis). In some embodiments, the roller cone includes an innermost region proximate to a first axial end of the cone axis and proximate to the rotational axis of bit body. The roller cone includes a first central region adjacent to and radially outward from the innermost region (relative to the rotational axis of the bit body). The roller cone includes a second central region adjacent to and radially outward from the first central region (relative to the rotational axis of the bit body). The roller cone includes an outermost region adjacent to and radially outward from the second central region (relative to the rotational axis of the bit body).

As will be described in more detail herein, drill bit experiences the greatest torque on cutting elements in the second central region and/or outer region of the cutting profile of the drill bit. In some embodiments, more aggressive degrading of formation material in the second central region by the roller cone reduces the torque experienced at the shear cutting elements of the fixed blades of the drill bit. Adjusting the cutting element density of the regions of the roller cone can produce a more constant torque on the shear cutting elements of the fixed blades to limit failures of cutting elements experiencing high forces and/or torques. In some embodiments, the roller cone regions are at least partially aligned with the dimensions and/or positions of the primary, secondary, and tertiary fixed blades. In some embodiments, a drill bit according to the present disclosure can remove material in challenging earth formations with greater drilling rate, less torque, greater weight-on-bit, less wear or damage to the drill bit, or combinations thereof relative to conventional drill bits.

In some embodiments, a roller cone may be supported by a bit body. As the bit body rotates around a rotational axis of the drill bit, contact between the roller cone and the formation material produces a rotation of the roller cone around the cone axis. In some embodiments, the cone axis may be oriented with an outward component that may be substantially radial to the rotational axis. In some embodiments, the cone axis may be oriented with an outward component that may be raked relative to the radial direction and a rotational direction of the rotational axis. In some examples, a raked cone axis increases a shear force between cutting elements of the roller cone and the formation material as the drill bit and roller cone rotates.

In some embodiments, a cutting element of the roller cone(s) and/or the fixed blade(s), including but not limited to a shear cutting element, an apexed cutting element (conical, bullet, ridged), or another cutting element with another surface geometry, applies a force to the degraded material to remove at least a portion of the degraded material. In some embodiments, the cutting element may be a spinning cutting element that allows the cutting element (such as a shear cutting element) to spin in a housing and expose different cutting surfaces to the formation. In some embodiments, the cutting element(s) may be made of or includes a polycrystalline diamond compact (PDC). In some embodiments, the cutting element(s) may be made of or includes a carbide, such as tungsten carbide. As will be described herein, the cutting elements may have different compositions and/or material properties related to the location of the cutting element in the roller cone and/or fixed blade.

In some embodiments, the roller cone cutting elements affixed to the roller cone are or include apexed cutting elements. For example, the roller cone cutting elements may have an apexed geometry, such as a conical cutting element, a bullet cutting element (i.e., curved conical surface), or a ridge or axe cutting element. As the roller cone rotates around the cone axis, the roller cone cutting elements apply a compression force to the formation material with a relatively high pressure at the apex of the apexed cutting element to degrade the formation material. In some embodiments, the roller cone cutting elements are press fit, compression fit, mechanically fastened, adhered, brazed, or otherwise affixed to the roller cone.

In some embodiments, the bit body has fixed blades affixed thereto and/or integrally formed therewith. The fixed blades have slots therebetween. In some embodiments, the fixed blade cutting elements affixed to the fixed blades are or include shear cutting elements. For example, the fixed blade cutting elements may have a substantially perpendicular or flat geometry, such as a cylindrical shear cutting element or angled shear cutting element. As the bit body rotates around the rotational axis, the fixed blade cutting elements apply a shear force to the formation material to degrade and/or remove the formation material. In some embodiments, the fixed blade cutting elements are press fit, compression fit, mechanically fastened, adhered, brazed, or otherwise affixed to the fixed blade(s).

In some embodiments, the drill bit has sets of fixed blades that include a plurality fixed blades of different geometries designed to cluster the fixed blade cutting elements together with slots therebetween. For example, a set of fixed blades may include a primary blade with fixed blade cutting elements arranged from an outermost surface of the drill bit cutting profile to proximate the rotational axis in the cone of the drill bit cutting profile. In some examples, a secondary blade may include fixed blade cutting elements arranged in less of the radial distance relative to the rotational axis, such as from the outermost surface of the drill bit cutting profile to the first central region of the drill bit cutting profile. In some examples, a secondary blade may include fixed blade cutting elements arranged in less of the radial distance relative to the rotational axis than the secondary blade, such as from the outermost of the drill bit cutting profile to the second central region of the drill bit cutting profile.

In some embodiments, the primary blade and the secondary blade have a slot therebetween that allows fluid flow between the blades to clear cuttings, swarf, or other debris. In some embodiments, a hydraulic nozzle directs a fluid flow, such as a drilling fluid flow, into the slot to clear the cuttings, swarf, or other debris. In some embodiments, degraded material remains in the degraded formation after the fixed blade cutting elements of the primary blade remove material from the formation. The fluid flow can further dislodge or flush remaining degraded material from the formation to further assist the second plurality of fixed blade cutting elements of the secondary blade further degrading and/or removing material.

In some embodiments, a cutting element density of the roller cone cutting elements varies on the roller cone in a radial direction relative to the rotational axis of the drill bit. In some embodiments, the cutting element density varies based at least partially on the location and arrangement of fixed blade cutting elements on the fixed blades of the hybrid drill bit. In at least some embodiments, by degrading the formation material by different amounts (relative to a radial direction) with the roller cone, torque on the fixed blade cutting elements may be reduced and/or balanced to allow more efficient removal of formation material by the fixed blade cutting elements.

In some embodiments, a hybrid drill bit degrades the formation with the axial compression forces of the roller cone cutting elements before efficiently removing the degraded material with the shear forces of the fixed blade cutting elements. During testing, a hybrid drill bit with roller cones according to the present disclosure exhibits a greater ROP relative to applied torque than a conventional roller cone bit, while reducing the forces to which the cutting elements are exposed in a conventional PDC bit.

In some embodiments, a roller cone has a cutting profile that exhibits a greater cutting element density in some regions of the cutting profile than others, in contrast to the cutting density of the conventional cutting profiles that are substantially constant. In some embodiments, the rolling cone cutting profile has an innermost region proximate to the rotational axis of the drill bit. In some embodiments, the roller cone cutting profile includes a first central region adjacent to and radially outward from the innermost region (relative to the rotational axis of the bit body). In some embodiments, the roller cone cutting profile includes a second central region adjacent to and radially outward from the first central region (relative to the rotational axis of the bit body). In some embodiments, the roller cone cutting profile includes an outermost region adjacent to and radially outward from the second central region (relative to the rotational axis of the bit body).

As described herein, the second central region experiences the highest torque per cutting element in a conventional drag bit. An increase in cutting element density in the second central region, in some embodiments, degrades the formation material proximate to the second central region more, reducing the torque on the fixed blade cutting elements in the second central region. In some embodiments, the roller cone has a cutting element density in the second central region that may be no less than 75% greater than a cutting element density in the first central region. In some embodiments, the roller cone has a cutting element density in the second central region that may be no less than 150% greater than a cutting element density in the first central region.

Cutting element density may be a quantity of cutting elements per square inch of roller cone surface and/or the outer perimeter of the cutting profile in the region. As used herein, a cutting element density for a region, in some embodiments, is an average cutting element density for the region. In some embodiments, the cutting elements are distributed substantially equally throughout the region. In some embodiments, the cutting elements are arranged with areas of greater or less cutting element density within a region. When comparing relative cutting element densities between regions, the values are the average cutting element density for the region unless otherwise noted. In some embodiments, the location of the cutting element may be determined by the location of a center axis of the cutting element at the roller cone surface and/or the cutting profile formed by the composite of the cutting elements.

In some embodiments, the roller cone has a cutting element density in the innermost region that may be no less than 75% greater than a cutting element density in the first central region. In some embodiments, the roller cone has a cutting element density in the innermost region that may be no less than 150% greater than a cutting element density in the first central region. In some embodiments, the innermost region contains comparatively few fixed blade cutting elements, and an increase in cutting element density in the innermost region of the roller cone cutting profile can improve degradation and removal of formation material proximate the cone of the drill bit.

In some embodiments, an inner first central region has a cutting element density no less than 50% more than that of an outer first central region. The inner first central region and the outer first central region are, in some embodiments, associated with the arrangement of fixed blade cutting elements on the primary blade and the secondary blade of a hybrid drill bit. In some embodiments, the cutting element density immediately adjacent to the rotational axis of the drill bit and in the outermost region exhibit a pronounced increase in cutting element density relative to a distance from the rotational axis of the drill bit (as in the graph) because the orientation of the surface of the roller cone or fixed blade supporting the cutting elements changes relative to the radial direction.

In some embodiments, the rolling cone cutting profile has an innermost region proximate to the rotational axis of the drill bit. In some embodiments, the roller cone cutting profile includes a first central region adjacent to and radially outward from the innermost region (relative to the rotational axis of the bit body). In some embodiments, the roller cone cutting profile includes a second central region adjacent to and radially outward from the first central region (relative to the rotational axis of the bit body). In some embodiments, the roller cone cutting profile includes an outermost region adjacent to and radially outward from the second central region (relative to the rotational axis of the bit body).

In some embodiments, the regions are defined by the location of the cutting elements in the radial direction. The radial direction may be perpendicular to the rotational axis of the drill bit. In some embodiments, the innermost region may be the portion of the cutting profile within the nearest 20% of the cutting profile to the rotational axis in the radial direction. In some embodiments, the first central region may be the portion of the cutting profile between 20% and 75% of the cutting profile in the radial direction. In some embodiments, the second central region may be the portion of the cutting profile between 75% and 95% of the cutting profile in the radial direction. In some embodiments, the outermost region may be the portion of the cutting profile between 95% and 100% of the cutting profile in the radial direction.

In some embodiments, the regions have other percentile ranges relative to the rotational axis of the drill bit. In some embodiments, the cutting profile of the roller cone has an inner region and an outer region, wherein the inner region has a lower cutting element density than the outer region. In some embodiments, the inner region may be the portion of the cutting profile adjacent to the rotational axis up to and including 30%, 40%, 50%, 60%, or 70% of the cutting profile in the radial direction away from the rotational axis. In some embodiments, the outer region may be the remaining portion of the cutting profile radially outward from the inner region. In some embodiments, the outer region may be the remaining portion of the cutting profile radially outward from the inner region except for the final 10% to 20% of the radial distance (i.e., 90% to 100% or 80% to 100%) of the roller cone cutting profile. In some embodiments, this outermost region corresponds to an outermost surface of the roller cone on which different cutting elements are used and/or does not substantially contribute to a downhole ROP of the roller cone and/or drill bit. In some embodiments, the outer region has a greater cutting element density than the inner region by at least 75%. In some embodiments, the outer region has a greater cutting element density than the inner region by at least 150%.

In some embodiments, the cutting element density varies across the cutting profile by 4 regions. In some embodiments, a first region may be the portion of the cutting profile adjacent to the rotational axis up to and including 25% of the cutting profile in the radial direction away from the rotational axis, a second region may be the portion of the cutting profile adjacent to the first region (i.e., 25%) up to and including 50% of the cutting profile in the radial direction away from the rotational axis, a third region may be the portion of the cutting profile adjacent to the second region (i.e., 50%) up to and including 75% of the cutting profile in the radial direction away from the rotational axis 617, and a fourth region may be the portion of the cutting profile adjacent to the third region (i.e., 75%) up to and including 100% of the cutting profile in the radial direction away from the rotational axis 617. In some embodiments, the third region has a greater cutting element density than the second region by at least 75%. In some embodiments, the third region has a greater cutting element density than the second region by at least 150%. In some embodiments, the fourth region has a greater cutting element density than the third region by at least 75%. In some embodiments, the fourth region has a greater cutting element density than the third region by at least 150%.

In some embodiments, the cutting element density varies across the cutting profile by 4 equal regions (i.e., quartiles). In some embodiments, the cutting element density may be calculated by the quartiles within an innermost region and the outermost region relative to a rotational axis of the drill bit that may not substantially contribute to the downhole ROP of the roller cone and/or drill bit. For example, the remaining cutting profile may be considered in quartiles (20% regions) from 10% of the radial distance of the cutting profile to 90% of the cutting profile. In some embodiments, a first region may be the portion of the cutting profile from 10% up to and including 30% of the cutting profile in the radial direction away from the rotational axis, a second region may be the portion of the cutting profile adjacent to the first region (i.e., 30%) up to and including 50% of the cutting profile in the radial direction away from the rotational axis, a third region may be the portion of the cutting profile adjacent to the second region (i.e., 50%) up to and including 70% of the cutting profile in the radial direction away from the rotational axis, and a fourth region may be the portion of the cutting profile adjacent to the third region (i.e., 70%) up to and including 90% of the cutting profile in the radial direction away from the rotational axis. In some embodiments, the third region has a greater cutting element density than the second region by at least 75%. In some embodiments, the third region has a greater cutting element density than the second region by at least 150%. In some embodiments, the fourth region has a greater cutting element density than the third region by at least 75%. In some embodiments, the fourth region has a greater cutting element density than the third region by at least 150%.

In some embodiments, the cutting elements are different between at least two of the regions. In some embodiments, the cutting elements in the first central region and the cutting elements in the second central region are different. In some embodiments, the cutting elements in the first central region and the cutting elements in the innermost region are different.

In some embodiments, the cutting elements vary between regions in composition. For example, the cutting elements in the first central region may be or include diamond and the cutting elements in the second central region may be or include a carbide, such as tungsten carbide. In some embodiments, the cutting elements vary between regions in toughness. For example, the cutting elements in the first central region may have a greater toughness than the cutting elements in the innermost region. In some embodiments, the cutting elements vary between regions in hardness. For example, the cutting elements in the second central region may have a greater hardness than the cutting elements in the first central region. In some embodiments, the cutting elements vary between regions in diameter. In some embodiments, the cutting elements vary between regions in depth of cut and/or height of the cutting element above the roller cone surface. In some embodiments, the cutting elements vary between regions in geometry. For example, the cutting elements in the innermost region may be or include ridge or axe cutting elements and the cutting elements in the first central region may be or include conical cutting elements. In another example, the cutting elements in the second central region may be or include conical cutting elements and the cutting elements in the first central region may be or include bullet cutting elements.

In some embodiments, the roller cone has at least an innermost region, a first central region, and a second central region. In some embodiments, the first central region includes an inner first central region and an outer first central region. In some embodiments, the regions of the roller cone and the roller cone cutting elements are at least partially related to the locations and/or arrangements of the fixed blade cutting elements on the fixed blades.

In some embodiments, a radial position (relative to the rotational axis) of the radially innermost fixed blade cutting element of the primary blade corresponds to the transition from the innermost region to the first central region. In some embodiments, a radial position (relative to the rotational axis) of the radially innermost fixed blade cutting element of the secondary blade corresponds to the transition from the inner first central region to the outer first central region. In some embodiments, a radial position (relative to the rotational axis) of the radially innermost fixed blade cutting element of the tertiary blade corresponds to the transition from the first central region to the second central region.

In some embodiments, the cutting element density varies between two regions of the radial length of the roller cone. In some embodiments, the cutting element density may be calculated by regions of at least 20% of the radial length of the roller cone within an innermost region and the outermost region relative to a rotational axis of the drill bit. In some embodiments, the innermost region and the outermost region do not substantially contribute to the downhole ROP of the roller cone and/or drill bit. In some embodiments, the innermost region may be about 10% of the radial length of the cutting profile. In some embodiments, the innermost region may be about 20% of the radial length of the cutting profile. In some embodiments, the innermost region may be between 10% and 20% of the radial length of the cutting profile. In some embodiments, the outermost region may be about 10% of the radial length of the cutting profile. In some embodiments, the outermost region may be about 20% of the radial length of the cutting profile. In some embodiments, the outermost region may be between 10% and 20% of the radial length of the cutting profile. For example, the at least 20% regions in the remaining cutting profile are located in the center portion from 10% of the radial distance of the cutting profile to 90% of the cutting profile.

In some embodiments, a first region may be the portion of the cutting profile from 10% up to and including 30% of the cutting profile in the radial direction away from the rotational axis, and a second region may be the portion of the cutting profile adjacent to the first region from 70% to and including 90% of the cutting profile in the radial direction away from the rotational axis. In some embodiments, a first region may be the portion of the cutting profile from 20% up to and including 40% of the cutting profile in the radial direction away from the rotational axis 617, and a second region may be the portion of the cutting profile adjacent to the first region from 45% to and including 70% of the cutting profile in the radial direction away from the rotational axis 617. In some embodiments, a first region may be the portion of the cutting profile from 60% to and including 88% of the cutting profile in the radial direction away from the rotational axis, and a second region may be the portion of the cutting profile adjacent to the first region from 28% up to and including 54% of the cutting profile in the radial direction away from the rotational axis. In some embodiments, a first region has a greater cutting element density than the second region by at least 75%. In some embodiments, the first region has a greater cutting element density than the second region by at least 150%. In some embodiments, the second region has a greater cutting element density than the first region by at least 75%. In some embodiments, the second region has a greater cutting element density than the first region by at least 150%. In some embodiments, the regions defined in the radial direction have a non-zero cutting element density. For example, a first region with a non-zero cutting element density has at least a 75% greater cutting element density than a second region with a non-zero cutting element density.

In some embodiments, a drill bit has a roller cone with one or more rows of cutting elements positioned on the roller cone. In some embodiments, a row may be a substantially concentric ring of cutting elements oriented on the roller cone perpendicular to the cone axis. For example, each cutting element in a row may overlap as the roller cone rotates around the cone axis and contribute to the same location in the cutting profile. In some embodiments, each row has a fixed or constant radial position that allows the rows to intermesh between roller cones on a drill bit. In some embodiments, a row may be located between the innermost portion and the outermost portion of the roller cone and/or drill bit and no cutting elements of the row (a first row or an adjacent row) are located in the innermost region or outermost region. In some embodiments, the innermost region and outermost region are the portions of the cone cutting profile within 10% to 20% of the ends of the cone cutting profile, as described herein.

A row may be, in some embodiments, a plurality of cutting elements that fall within a 0.5-inch radial distance region relative to the rotational axis of the bit and/or the radially innermost point of the cone. For example, a cutting element may be in a row with any other cutting elements having a center axis within 0.25 inches of the center axis of the cutting element in either radial direction of the roller cone. In some embodiments, a region in the radial direction that includes no cutting elements (i.e., has a zero cutting element density) may be not considered a row, as it lacks any cutting elements.

In some embodiments, a first row has a cutting element density that may be at least 75% greater than an adjacent row. In some embodiments, a first row has a cutting element density that may be at least 150% greater than an adjacent row. In some embodiments, an adjacent row may be a second row that may be less than 0.5 inches from the first row in the radial direction. In some embodiments, an adjacent row may be a second row that may be less than 0.5 inches from the first row in the radial direction with no cutting elements positioned radially therebetween. In some embodiments, a second row may be adjacent to a first row on the same roller cone. In some embodiments, a second row may be adjacent to a first row on drill bit cutting profile.

The present disclosure relates to systems and methods for drilling in an earth formation according to any of the following:

Clause 1. A roller cone comprising: an innermost region having roller cone cutting elements arranged thereon, a first central region having roller cone cutting elements arranged thereon, and a second central region having roller cone cutting elements arranged with a cutting element density no less than 75% greater than the cutting element density of the first central region.

Clause 2. The roller cone of clause 1, wherein the roller cone cutting elements in the first central region are different from the roller cone cutting elements in the second central region.

Clause 3. The roller cone of clause 2, wherein the roller cone cutting elements in the first central region are a different composition from the roller cone cutting elements in the second central region.

Clause 4. The roller cone of clause 3, wherein the roller cone cutting elements in the first central region have a greater toughness than the roller cone cutting elements in the second central region, and the roller cone cutting elements in the second central region have a greater hardness than the roller cone cutting elements in the first central region.

Clause 5. The roller cone of clause 2 or 3, wherein the roller cone cutting elements in the first central region are a different geometry from the roller cone cutting elements in the second central region.

Clause 6. The roller cone of any preceding clause, wherein the roller cone cutting elements in the first central region are different from the roller cone cutting elements in the innermost region.

Clause 7. The roller cone of clause 6, wherein the roller cone cutting elements in the first central region are a different composition from the roller cone cutting elements in the innermost region.

Clause 8. The roller cone of clause 7, wherein the roller cone cutting elements in the first central region have a greater toughness than the roller cone cutting elements in the innermost region, and the roller cone cutting elements in the innermost region have a greater hardness than the roller cone cutting elements in the first central region.

Clause 9. The roller cone of clause 6, wherein the roller cone cutting elements in the first central region are a different geometry from the roller cone cutting elements in the innermost region.

Clause 10. The roller cone of any preceding clause, further comprising a recess in a roller cone surface in at least the first central region.

Clause 11. The roller cone of clause 10, wherein the recess has a depth inversely proportional to a cutting element height of the roller cone cutting elements in the first central region.

Clause 12. The roller cone of any preceding clause, wherein the cutting element density of the innermost region may be no less than 75% greater than in the first central region.

Clause 13. The roller cone of any preceding clause, wherein the second central region has a cutting element density no less than 150% greater than the cutting element density of the innermost region.

Clause 14. A drill bit comprising: a bit body having a rotational axis; a roller cone supported by the bit body, the roller cone of any of clauses 1-13.

Clause 15. The drill bit of clause 14, wherein the roller cone cutting elements are apexed cutting elements.

Clause 16. The drill bit of clause 14 or 15, wherein the fixed blade cutting elements are shear cutting elements.

Clause 17. The drill bit of any of clauses 14-16, further comprising a second fixed blade having a second fixed blade with a second plurality of fixed cutting elements affixed thereto radially overlapping an outer first central region and the second central region and the second fixed blade includes no cutting elements radially overlapping an inner first central region.

Clause 18. The drill bit of clause 17, further comprising a third fixed blade having a third fixed blade with a third plurality of fixed cutting elements affixed thereto radially overlapping the second central region and the third fixed blade includes no cutting elements radially overlapping the first central region and the innermost region.

Clause 19. The drill bit of any of clauses 14-18, further comprising a second fixed blade having a second fixed blade with a second plurality of fixed cutting elements affixed thereto radially overlapping the second central region and the second fixed blade includes no cutting elements radially overlapping the first central region and the innermost region.

Clause 20. A roller cone comprising: an innermost region having roller cone cutting elements arranged thereon, a first central region having roller cone cutting elements arranged thereon with a toughness greater than the roller cone cutting elements of the innermost region, and a second central region having roller cone cutting elements with a hardness greater than the roller cone cutting elements of the first central region.

Clause 21. A roller cone comprising: an inner region having roller cone cutting elements arranged thereon, and an outer region having roller cone cutting elements arranged with a cutting element density no less than 75% greater than the cutting element density of the inner region.

Clause 22. The roller cone of clause 21, wherein the roller cone cutting elements in the inner region are different from the roller cone cutting elements in the outer region.

Clause 23. The roller cone of clause 22, wherein the roller cone cutting elements in the inner region are a different composition from the roller cone cutting elements in the outer region.

Clause 24. The roller cone of clause 23, wherein the roller cone cutting elements in the inner region have a greater toughness than the roller cone cutting elements in the outer region, and the roller cone cutting elements in the outer region have a greater hardness than the roller cone cutting elements in the inner region.

Clause 25. The roller cone of clause 22 or 23, wherein the roller cone cutting elements in the inner region are a different geometry from the roller cone cutting elements in the outer region.

Clause 26. A roller cone comprising: a cutting profile including: a first region proximate to a first end of the cutting profile having roller cone cutting elements arranged thereon, a second region radially outward from the first region of the cutting profile having roller cone cutting elements arranged thereon, a third region radially outward from the second region of the cutting profile having roller cone cutting elements arranged thereon, and a fourth region having roller cone cutting elements arranged with a cutting element density no less than 75% greater than the cutting element density of the third region.

Clause 27. The roller cone of clause 26, wherein the roller cone cutting elements in the third region are different from the roller cone cutting elements in the fourth region.

Clause 28. The roller cone of clause 27, wherein the roller cone cutting elements in the third region are a different composition from the roller cone cutting elements in the fourth region.

Clause 29. The roller cone of clause 28, wherein the roller cone cutting elements in the third region have a greater toughness than the roller cone cutting elements in the fourth region, and the roller cone cutting elements in the fourth region have a greater hardness than the roller cone cutting elements in the third region.

Clause 30. The roller cone of clause 27 or 28, wherein the roller cone cutting elements in the third region are a different geometry from the roller cone cutting elements in the fourth region.

Clause 31. The roller cone of clause 26, wherein the roller cone cutting elements in the second region are different from the roller cone cutting elements in the third region.

Clause 32. The roller cone of clause 31, wherein the roller cone cutting elements in the second region are a different composition from the roller cone cutting elements in the third region.

Clause 33. The roller cone of clause 32, wherein the roller cone cutting elements in the second region have a greater toughness than the roller cone cutting elements in the third region, and the roller cone cutting elements in the third region have a greater hardness than the roller cone cutting elements in the second region.

Clause 34. The roller cone of clause 31 or 32, wherein the roller cone cutting elements in the second region are a different geometry from the roller cone cutting elements in the third region.

Clause 35. The roller cone of any of clauses 26-34, further comprising an innermost region adjacent to the first region and between the first region and the first end of the cutting profile.

Clause 36. The roller cone of Clause 35, wherein the innermost region is between 10% and 20% of a length of the cutting profile.

Clause 37. The roller cone of any of clauses 26-36, further comprising an outermost region adjacent to the fourth region and between the fourth region and a second end of the cutting profile.

Clause 38. The roller cone of Clause 37, wherein the outermost region is between 10% and 20% of a length of the cutting profile.

Clause 39. A drill bit comprising: a bit body having a rotational axis; a roller cone supported by the bit body, the roller cone of any of clauses 20-38.

Clause 40. A roller cone comprising: a cutting profile including: a first region of the cutting profile having roller cone cutting elements arranged thereon, a second region of the cutting profile having roller cone cutting elements arranged thereon with a cutting element density no less than 75% greater than the cutting element density of the first region.

Clause 41. The roller cone of Clause 40, wherein the first region is no less than 20% of the radial length of the cutting profile.

Clause 42. The roller cone of Clause 40 or 41, wherein the second region is no less than 20% of the radial length of the cutting profile.

Clause 43. The roller cone of any of Clauses 40-42, wherein the first region and second region have different radial lengths.

Clause 44. The roller cone of any of Clauses 40-43, wherein the first region and second region are located between an innermost region and an outermost region.

Clause 45. The roller cone of any of Clauses 40-44, wherein the first region and second region are adjacent to one another.

Clause 46. A roller cone comprising: a cone cutting profile including: a first row of cutting elements, and a second row of cutting elements with a cutting element density no less than 75% greater than the cutting element density of the first row, wherein the first row and second row are adjacent to one another.

Clause 47. The roller cone of Clause 46, wherein the row is no more than 0.5 inches wide in the radial direction.

Clause 48. The roller cone of Clause 46 or 47, wherein the first row and second row are less than 0.5 inches from one another in the radial direction.

Clause 49. The roller cone of any of Clauses 46-48, wherein the first row and second row have no cutting elements positioned therebetween in the cone cutting profile.

Clause 50. The roller cone of any of clauses 46-49, wherein the first row and the second row are not located in an innermost region or an outermost region of the cone cutting profile.

Clause 51. A drill bit comprising: a bit cutting profile including: a first row of cutting elements, and a second row of cutting elements with a cutting element density no less than 75% greater than the cutting element density of the first row, wherein the first row and second row are adjacent to one another.

Clause 52. The roller cone of Clause 51, wherein the row is no more than 0.5 inches wide in the radial direction.

Clause 53. The roller cone of Clause 51 or 52, wherein the first row and second row are less than 0.5 inches from one another in the radial direction.

Clause 54. The roller cone of any of Clauses 51-53, wherein the first row and second row have no cutting elements positioned therebetween in the bit cutting profile.

Clause 55. The roller cone of any of clauses 51-54, wherein the first row and the second row are not located in an innermost region or an outermost region of the bit cutting profile.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A drill bit comprising:

a bit body having a rotational axis;

a first fixed blade fixed relative to the bit body with a first plurality of fixed blade cutting elements affixed to the first fixed blade;

a second fixed blade fixed relative to the bit body with a second plurality of fixed blade cutting elements affixed to the second fixed blade; and a roller cone supported by the bit body, the roller cone including:

an innermost region having roller cone cutting elements arranged thereon, wherein the roller cone cutting elements of the innermost region are closest to the rotational axis, an inner first central region having roller cone cutting elements arranged thereon, wherein a first transition from the innermost region to the inner first central region corresponds to a radially innermost fixed cutting element of the first plurality of fixed blade cutting elements, and an outer first central region having roller cone cutting elements arranged thereon with a cutting element density no less than 75% greater than a cutting element density of the inner first central region, wherein a second transition from the inner first central region to the outer first central region corresponds to a radially innermost fixed cutting element of the second plurality of fixed blade cutting elements.

2. The drill bit of claim 1, wherein the roller cone cutting elements in the inner first central region are different from the roller cone cutting elements in the outer first central region.

3. The drill bit of claim 2, wherein the roller cone cutting elements in the inner first central region are a different composition from the roller cone cutting elements in the outer first central region.

4. The drill bit of claim 3, wherein the roller cone cutting elements in the inner first central region have a greater toughness than the roller cone cutting elements in the outer first central region.

5. The drill bit of claim 2, wherein the roller cone cutting elements in the inner first central region are a different geometry from the roller cone cutting elements in the outer first central region.

6. The drill bit of claim 1, wherein the inner first central region and the outer first central region comprise 20% to 80% of a cutting profile of the roller cone.

7. The drill bit of claim 1, wherein the inner first central region is larger than the outer first central region.

8. The drill bit of claim 1, wherein the outer first central region is larger than the inner first central region.

9. The drill bit of claim 1, wherein the inner first central region and the outer first central region are separated by a first zone, wherein the first zone has no cutting elements disposed therein.

10. The drill bit of claim 1, wherein the inner first central region is adjacent to the outer first central region.

11. The drill bit of claim 1, wherein the inner first central region comprises 20% to 50% of a cutting profile in a radial direction and wherein the outer first central region comprises 50% to 80% of the cutting profile in a radial direction.

12. The drill bit of claim 1, wherein the roller cone cutting elements are apexed cutting elements.

13. The drill bit of claim 1, wherein the fixed blade cutting elements are shear cutting elements.

14. The drill bit of claim 1, further comprising a third fixed blade with a third plurality of fixed blade cutting elements affixed thereto radially overlapping the outer first central region and the third fixed blade includes no cutting elements radially overlapping the inner first central region and the innermost region.

15. The drill bit of claim 14, wherein a third transition from the outer first central region to a second central region corresponds to a radially innermost fixed cutting element of the third plurality of fixed blade cutting elements.

16. A drill bit comprising:

a bit body having a rotational axis;

a first fixed blade fixed relative to the bit body with a first plurality of fixed blade cutting elements affixed to the first fixed blade;

a second fixed blade fixed relative to the bit body with a second plurality of fixed blade cutting elements affixed to the second fixed blade;

a third fixed blade fixed relative to the bit body with a third plurality of fixed blade cutting elements affixed to the third fixed blade; and a roller cone supported by the bit body, the roller cone including:

an innermost region having roller cone cutting elements arranged thereon, wherein the roller cone cutting elements of the innermost region are closest to the rotational axis, an inner first central region having roller cone cutting elements arranged thereon, wherein a first transition from the innermost region to the inner first central region corresponds to a radially innermost fixed cutting element of the first plurality of fixed blade cutting elements, an outer first central region having roller cone cutting elements arranged thereon, wherein a second transition from the inner first central region to the outer first central region corresponds to a radially innermost fixed cutting element of the second plurality of fixed blade cutting elements, and a second central region having roller cone cutting elements arranged thereon, wherein a third transition from the outer first central region to the second central region corresponds to a radially innermost fixed cutting element of the third plurality of fixed blade cutting elements, wherein a cutting element density of at least one of the inner first central region, the outer first central region, and the second central region is no less than 75% greater than the cutting element density of another of the inner first central region, the outer first central region, and the second central region.

17. The drill bit of claim 16, wherein the cutting element density of the outer first central region is no less than 75% greater than the cutting element density of the inner first central region.

18. The drill bit of claim 16, wherein the cutting element density of the second central region is no less than 75% greater than the cutting element density of the outer first central region.

19. The drill bit of claim 16, further comprising an outermost region of the roller cone, wherein the outermost region has a radial length no less than 10% of a radius of the drill bit relative to the rotational axis.

20. A drill bit comprising:

a bit body having a rotational axis;

a first fixed blade fixed relative to the bit body with a first plurality of fixed blade cutting elements affixed to the first fixed blade;

a second fixed blade fixed relative to the bit body with a second plurality of fixed blade cutting elements affixed to the second fixed blade; and a roller cone supported by the bit body, the roller cone including:

an innermost region having roller cone cutting elements arranged thereon, wherein the roller cone cutting elements of the innermost region are closest to the rotational axis, a first central region having roller cone cutting elements arranged thereon, wherein a first transition from the innermost region to the first central region corresponds to a radially innermost fixed cutting element of the first plurality of fixed blade cutting elements, a second central region having roller cone cutting elements arranged thereon, wherein a second transition from the first central region to the second central region corresponds to a radially innermost fixed cutting element of the second plurality of fixed blade cutting elements, and an outermost region having roller cone cutting elements arranged thereon, wherein the outermost region has a radial length no less than 10% of a radius of the drill bit relative to the rotational axis, wherein a cutting element density of the second central region is no less than 75% greater than the cutting element density of the first central region.

* * * * *